US005253817A

United States Patent [19]

Hatakeyama et al.

[11] Patent Number: 5,253,817

[45] Date of Patent: Oct. 19, 1993

[54] BUNCH WINDING PROCESSING APPARATUS

[75] Inventors: Yasunori Hatakeyama, Shiga; Kenichi Ueda, Kyoto, both of Japan

[73] Assignee: Murata Kikai Kabushiki Kaisha, Kyoto, Japan

[21] Appl. No.: 861,431

[22] Filed: Mar. 31, 1992

[30] Foreign Application Priority Data

Apr. 9, 1991 [JP] Japan ..... 3-076531

[51] Int. Cl.[5] ..... B65H 54/00

[52] U.S. Cl. ..... 242/18 R; 242/35.6 E

[58] Field of Search ..... 242/18 R, 18 EW, 35.6 R, 242/35.6 E, 35.5 R, 35.5 A

[56] References Cited

U.S. PATENT DOCUMENTS 4,760,969 8/1988 Otoshima et al. ..... 242/18 R 4,995,562 2/1991 Koga et al. ..... 242/35.6 E

*Primary Examiner*—Stanley N. Gilreath

*Attorney, Agent, or Firm*—Spensley Horn Jubas & Lubitz

[57] ABSTRACT

A bunch winding processing apparatus for a package which has been formed by retaining a start end of yarn in a slit formed at an end portion of a paper tube, then making a bunch winding and subsequently performing a regular winding through a nip point, the bunch winding processing apparatus including a bunch yarn guide for pressing down a predetermined length of a bunch winding yarn from the nip point onto the paper tube, an unwinding mechanism for unwinding the remaining portion of the bunch winding yarn from the nip point up to the start end, and a heat cutter mounted in the bunch yarn guide to cut the pressed yarn thermally after the unwinding.

16 Claims, 22 Drawing Sheets

BUNCH WINDING PROCESSING APPARATUS

BACKGROUND OF THE INVENTION

1. Field of the Invention

The present invention relates to a bunch winding processing apparatus for processing a bunch winding yarn on a paper tube end of a package.

2. Prior Art

In a filament yarn take-up machine, yarn obtained by continuous spinning is taken up and a full-loaded package is fed to a desired step or is shipped as product.

A slit is formed in an end portion of a paper tube and a yarn end is retained in the slit, followed by bunch winding and subsequent regular winding through a nip point, to obtain a full-loaded package.

In the case where take-up packages are used successively in such a manner that a winding terminal end of a preceding package and a winding start end of a succeeding package are tied together, it is necessary to process such winding terminal end and start end.

In Japanese Utility Model Laid Open No. 37169/90 the applicant in the present case proposed a device which a predetermined length of bunch winding yarn adjacent a winding start end is allowed to remain, while another length of bunch winding yarn more closely adjacent the nip point is unwound.

In such proposed device, a roller is contacted with a yarn layer of bunch winding and is rotated to loosen the bunch winding and thereby unwind and draw it out, thereafter the yarn is allowed to remain a predetermined length from a nip point, while the other yarn portion is unwound, and the yarn allowed to remain is again wound round a paper tube.

According to the above method, however, since the yarn is once pulled out up to the nip point with the roller and then wound again onto a paper tube, the yarn quality is deteriorated particularly in the case of yarn for clothing or yarn of fine denier, for example, the yarn is stretched out.

SUMMARY AND OBJECT OF THE INVENTION

It is therefore an object of the present invention to overcome the above-mentioned problem and provide a bunch winding processing apparatus capable of unwinding a bunch winding yarn while allowing the yarn to remain a predetermined length from a nip point, without deteriorating the yarn quality.

It is another object of the present invention to provide a paper tube position detecting device for bunch processing capable of detecting a rotational position of a paper tube accurately at the time of unwinding a bunch winding on the paper tube.

According to the present invention, in order to achieve the above-mentioned object, there is provided a bunch winding processing apparatus for a package which has been formed by retaining a start end of yarn in a slit formed at an end portion of a paper tube, then making a bunch winding and subsequently performing a regular winding through a nip point, the bunch winding processing apparatus including a bunch yarn guide for pressing down a predetermined length of a bunch winding yarn from the nip point onto the paper tube, an unwinding mechanism for unwinding the remaining portion of the bunch winding yarn from the nip point up to the start end, and a heat cutter mounted in the bunch yarn guide to cut the pressed yarn thermally after the unwinding.

In the above construction, at the time of unwinding a bunch winding, a predetermined length of the bunch winding yarn from the nip point is pressed down by the bunch yarn guide, and after unwinding of the remaining portion of the yarn, the pressed yarn portion is cut, whereby the bunch winding yarn of the predetermined length from the nip point can be allowed to remain without deterioration of its quality.

Furthermore, according to the present invention, in a paper tube position detecting device there is provided a sensor for detecting a paper tube position at the time of unwinding a bunch winding on a paper tube.

DETAILED DESCRIPTION OF PREFERRED EMBODIMENTS

An embodiment of the present invention will be described in detail hereinunder with reference to the accompanying drawings.

Figure 1:
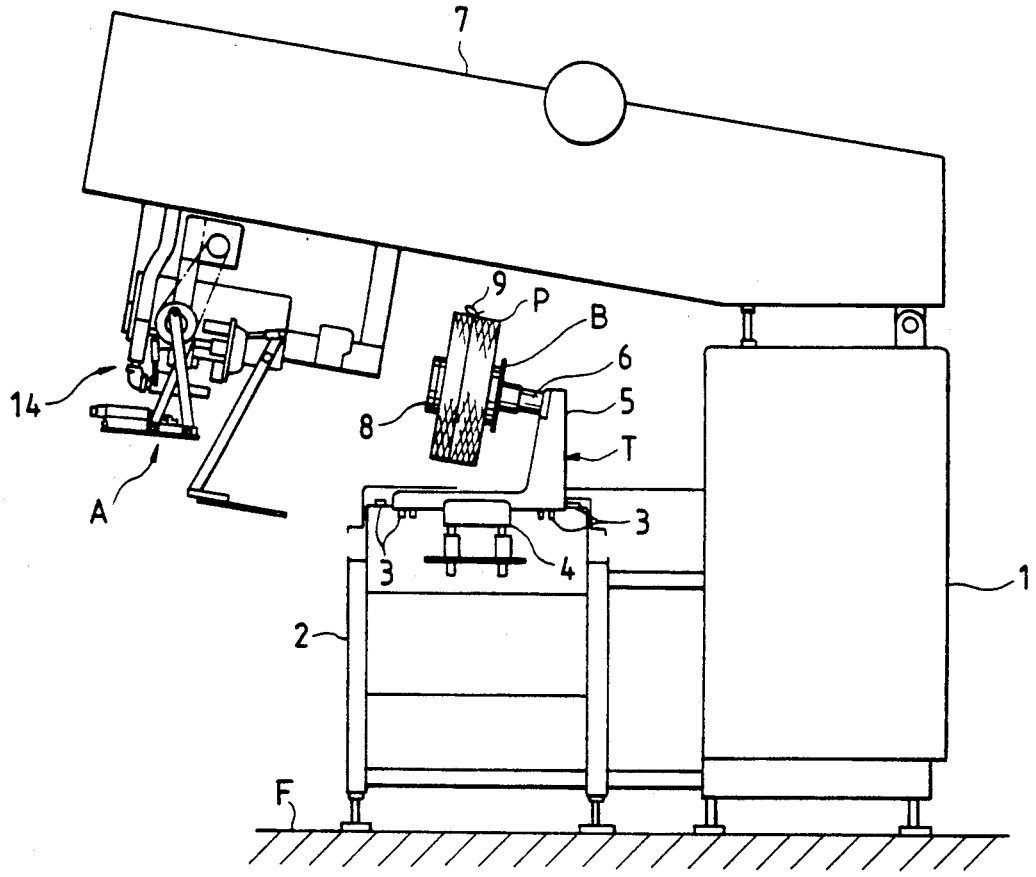
FIG. 1 is a view showing the whole of a yarn processing apparatus according to an embodiment of the present invention.

FIG. 1 is a diagram showing the whole of a yarn processing apparatus according to the present invention.

FIG. 1, a base 1 is provided on a floor surface F, and a carrier member 2 for a tray T which is for the support and conveyance of a package P, is mounted to the base 1. On the carrier member 2 are provided rollers 3 for conveyance of the tray T, and also provided is a stopper 4 for stopping the tray T. The tray T is constituted by a generally L-shaped support member 5, on which is provided a peg 6 extending obliquely upwards and rotatable with respect to the support member 5. Further, a paper tube B of the package P is fitted on the peg 6 to support the package rotatable.

On the base 1 is provided a support frame 7 extending obliquely upwards in parallel with the peg 6 on the tray T, and a bunch winding processing apparatus A according to the present invention is mounted to the support frame 7.

Figure 2:
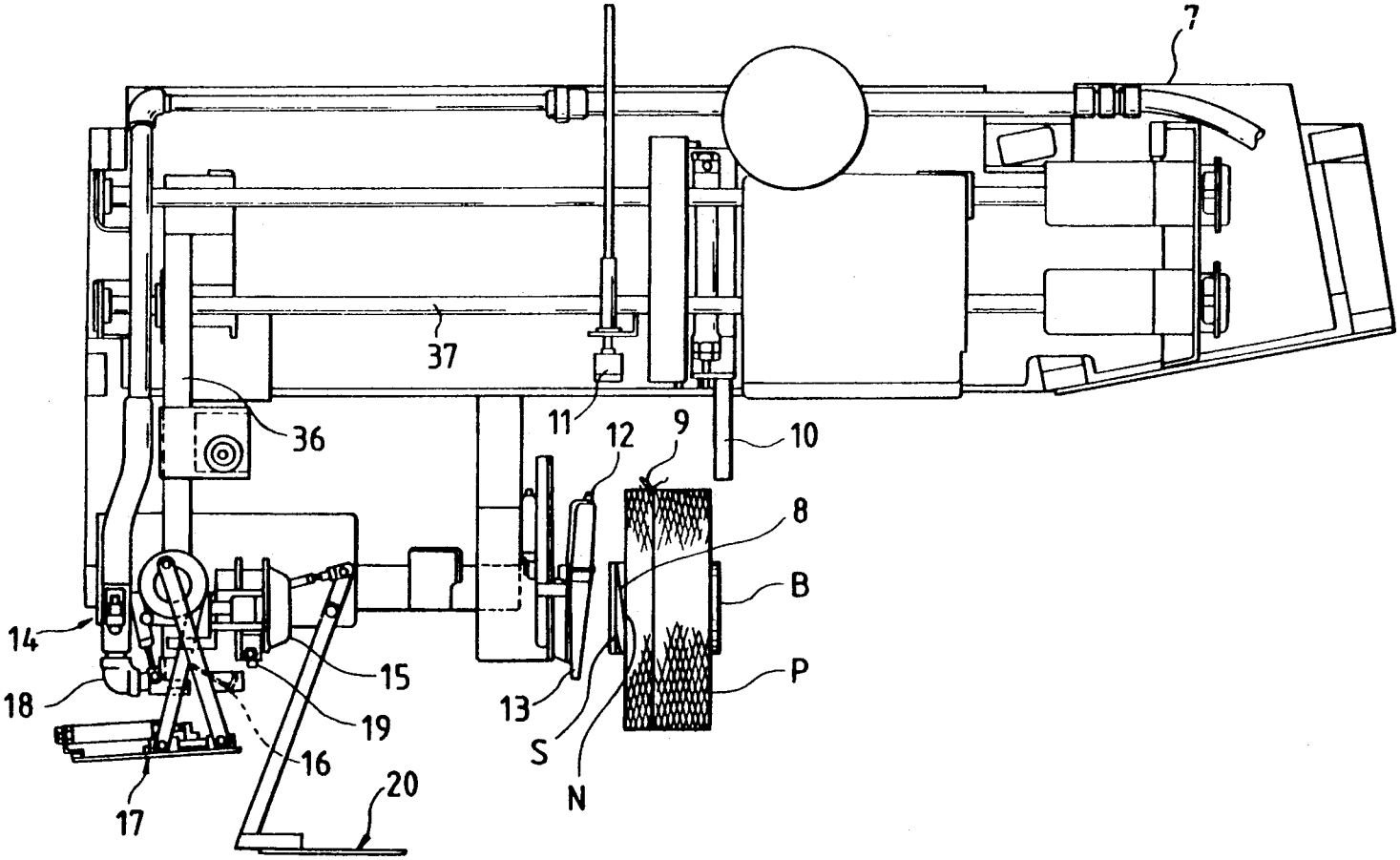
FIG. 2 is a detail view thereof.

As shown in FIG. 2, a winding start end of the package P is retained in a slit S, then a bunch winding 8 is made, followed by a regular winding from the nip point N. In the figure, a winding terminal end is in a tied state as indicated at 9.

Figure 3:
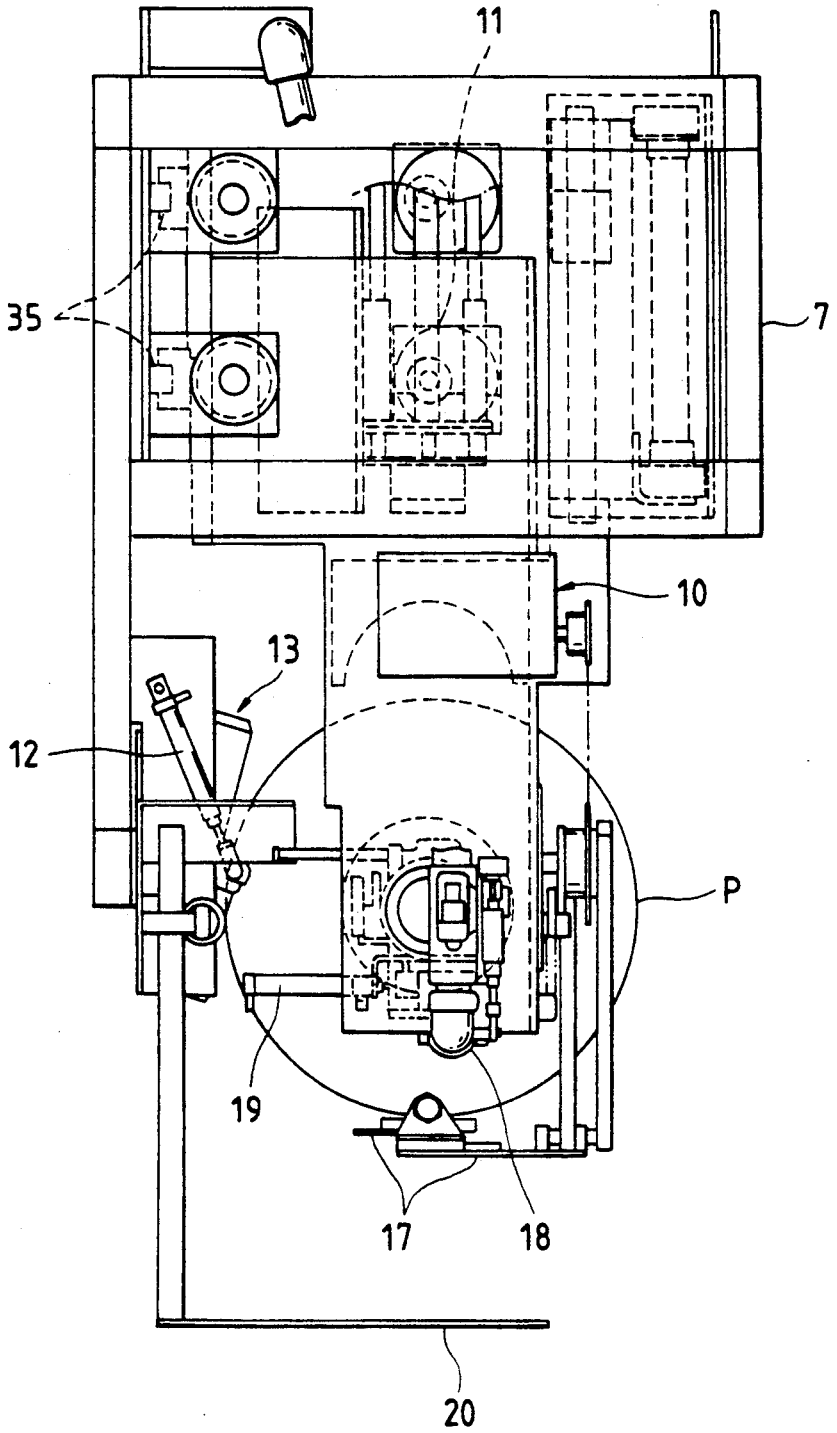
FIG. 3 is a left side view of FIG. 2.

In FIGS. 2 and 3, a paper tube pressing means 10 for pressing down an end of the paper tube B on the side opposite to the bunch winding 8 to stop the rotation of the paper tube, a bunch seal sticker 11 for retaining an end portion of a predetermined length of yarn on the paper tube B after release of the bunch winding, a bunch yarn guide 12 for pressing down the bunch winding yarn of the predetermined length, and a heat cutter 13, are mounted to the support frame 7, and also mounted to the same frame is a bunch winding release mechanism 14.

The bunch winding release mechanism 14 is provided with a cone member 15 adapted for fitting into the paper tube B, a hook means 16 for hooking and unwinding a bunch winding yarn, a yarn removing means 17 for gripping the bunch winding yarn which has been unwound by the hook means 16 and taking it away from the paper tube B, a suction pipe 18 for removing the bunch winding yarn thus taken away, a chuck means 19 for chucking the yarn which has been sucked by the suction pipe 18, and a sub-ring means 20 for pushing up the yarn which has been unwound by the hook means 16 and taking it away from the paper tube B.

Figure 4C:
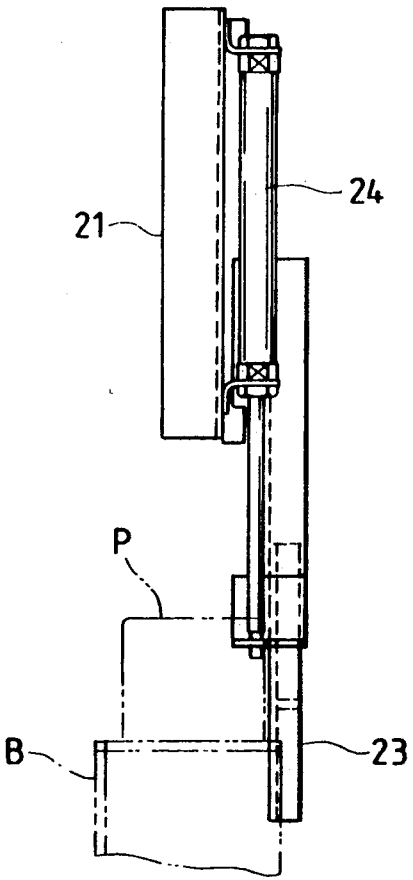
FIGS. 4*a*, 4*b* and 4*c* are views showing the details of a paper spool pressing means.
Figure 4B:
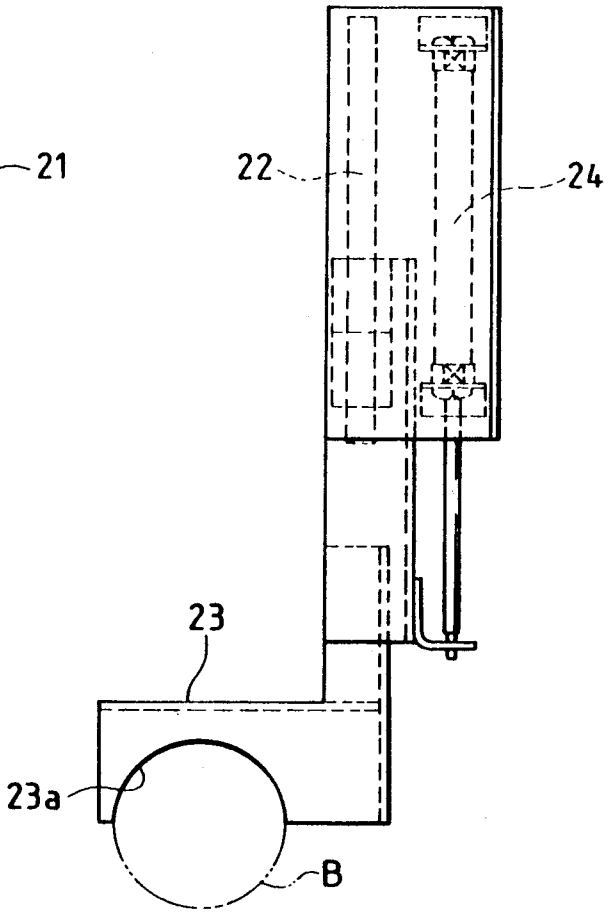
Figure 4A:
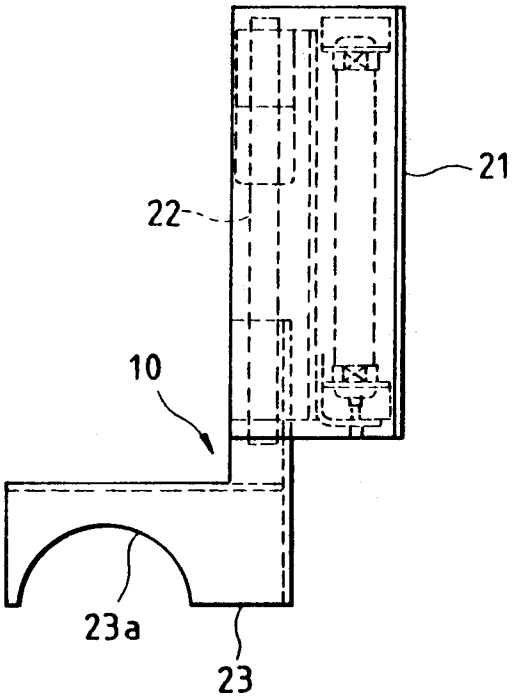

In the paper tubes pressing means 10, as shown in FIG. 4, a presser plate 23 is mounted to a stationary support 21 of the support frame 7 vertically movably through a linear bearing 22. The presser plate 23 is moved up and down by means of a lift cylinder 24 and it has an arcuate recess 23*a* conforming to the curvature of the paper tube B. When the presser plate 23 is brought down from its stand-by position by means of the lift cylinder 24, as shown in FIG. 4*a*, it comes into engagement with the paper tube B of the package P to stop the 4*c*.

FIG. 5 shows the details of the bunch yarn guide 12 for pressing down a predetermined length of a bunch winding yarn and also of the heat cutter 13.

Figure 5A:
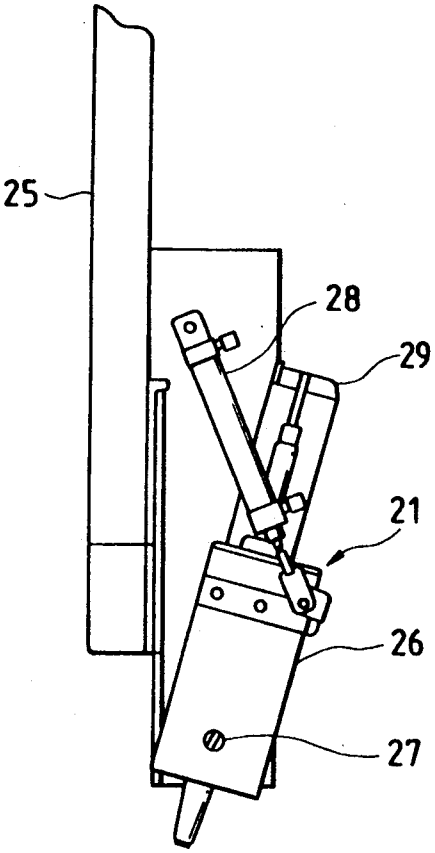
FIGS. 5*a*, 5*b*, 5*c* and 5*d* are views showing the details of a bunch yarn guide and a heat cutter both illustrated in FIG. 2.
Figure 5B:
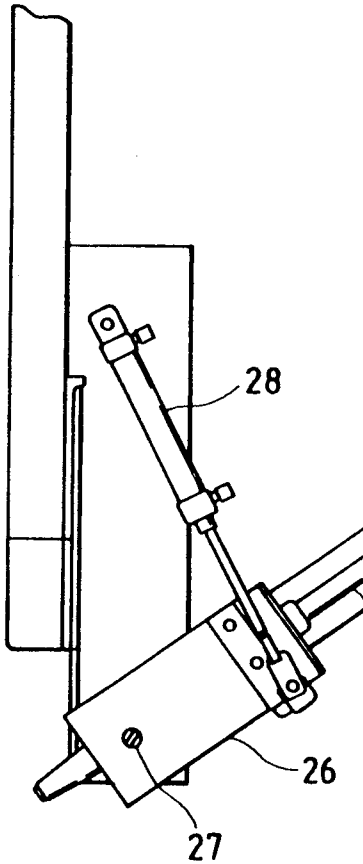
Figure 5C:
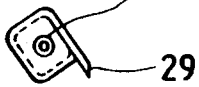
Figure 5D:
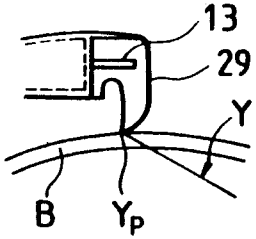

The bunch yarn guide 12 comprises a guide body 26 supported by a stationary frame 25 of the support frame 7 so as to be pivotable about a pivot shaft 27, and a pressing cylinder 28 mounted to the stationary frame 25 for rotating the guide body 26. The guide body 26 has a pressing pawl 29 at the front end thereof, and a heater 30 is provided within the guide body 26 to constitute a heat cutter 13. When the guide body 26 has been turned from its stand-by position shown in FIG. 5*a* up to its pivoted position shown in FIG. 5*b*, the front end of the pressing pawl 29 abuts the paper tube B in a predetermined position, as shown in FIG. 5*c*. In this state, yarn $Y_p$ of a predetermined length on the nip point side is pressed down and the bunch winding yarn $Y_p$ on the start end side is pressed down. Further, after the end of a bunch unwinding operation which will be described later, the yarn $Y_p$ is cut thermally in the pressed position by means of the heat cutter 13.

The bunch seal sticker 11, as shown in FIGS. 2 and 3, is provided vertically movably in the support frame 7 located above the paper tube B to stick the nip-side yarn end which has been cut by the heat cutter 13 as mentioned above onto the paper tube B through a labeling tape.

In the bunch winding release mechanism 14, as shown in FIGS. 1, 2 and 3, a base 36 is provided movably on rails 35 mounted in the support frame 7, the base 36 being moved toward and away from the paper tube B of the package P by means of a feed screw 37.

Figure 6:
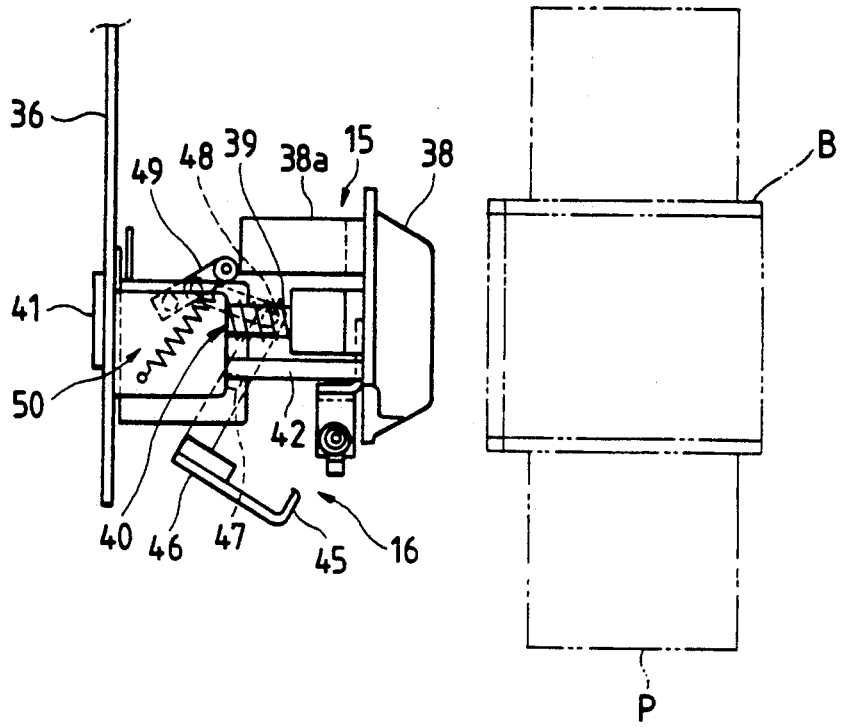
FIG. 6 is a view showing the details of a cone member and a hook means both illustrated in FIG. 2.
Figure 7:
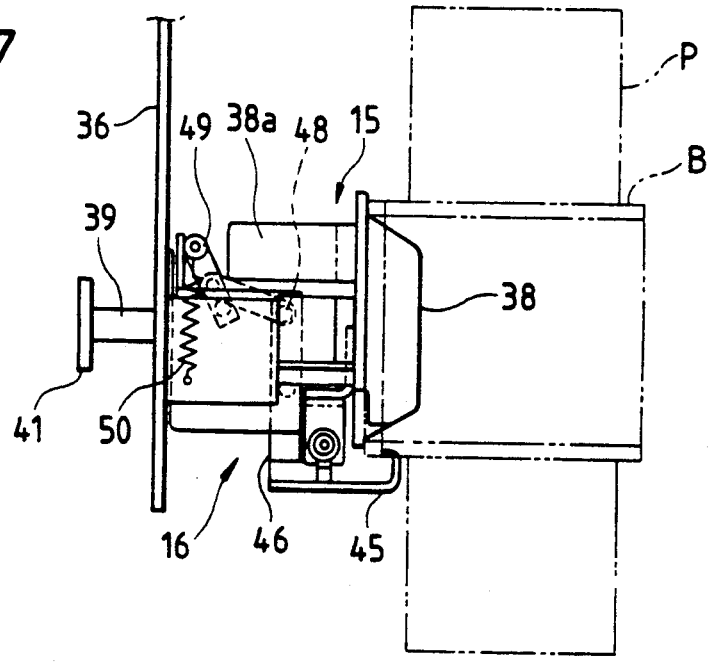
FIG. 7 is a view showing a fitted state of the cone member illustrated in FIG. 2 into a paper spool.

The cone member 15 has a cone portion 38 for fitting into the paper tube B, as shown in FIGS. 6 and 7. A support shaft 39 is connected to the cone portion 38 and it is mounted to the base 36 axially movably. Further, as shown in FIG. 6, the support shaft 39 is normally urged by a spring 40 to a position in which a stopper 41 provided at the rear end of the support shaft 39 abuts the base 36, as shown in FIG. 6. When the base 36 approaches the paper tube B and the cone portion 38 comes into engagement with the paper tube, the support shaft 39 moves back with respect to the base 36 and a fitted state is ensured by virtue of the spring 40, as shown in FIG. 7. Further, the base 36 is provided with a guide bar 42, which is fitted in the cone portion 38 to prevent the rotation of the cone portion 38. The hook means 16 is constituted by a L-shaped hook lever 46 which has at a front end thereof a hook portion 45 for hooking the bunch winding yarn. The hook lever 46 is connected to the base 36 pivotably through a stationary shaft 47, and a pivot pin 48 on an operating point side of the hook lever 46 is connected for interlock with the support shaft 39 of the cone member 15. To the pivot pin 48 is connected a return link 49, to which is connected a return spring 50.

In the hook means 16, when the cone portion 38 is in a position away from the paper tube B, as shown in FIG. 6, the hook lever 46 is held in its illustrated position by the return spring 50 through the return link 49, while when the cone portion 38 is fitted in the paper tube B as in FIG. 7, the hook lever 46 is turned in the counterclockwise direction through the link 49 by means of a pusher 38*a* fixed to the cone portion 38 to push a front end of the hook portion 45 against the surface of the paper tube B, now ready for hooking the bunch winding yarn.

Figure 8C:
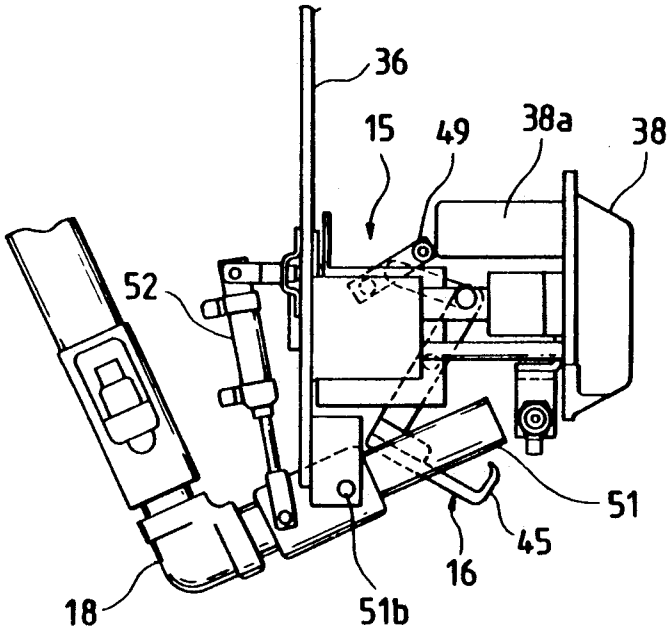
FIGS. 8*a*, 8*b* and 8*c* are views showing the details of the cone member and a suction pipe both illustrated in FIG. 2.
Figure 8B:
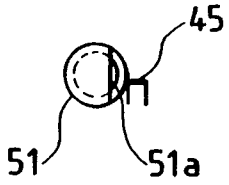
Figure 8A:
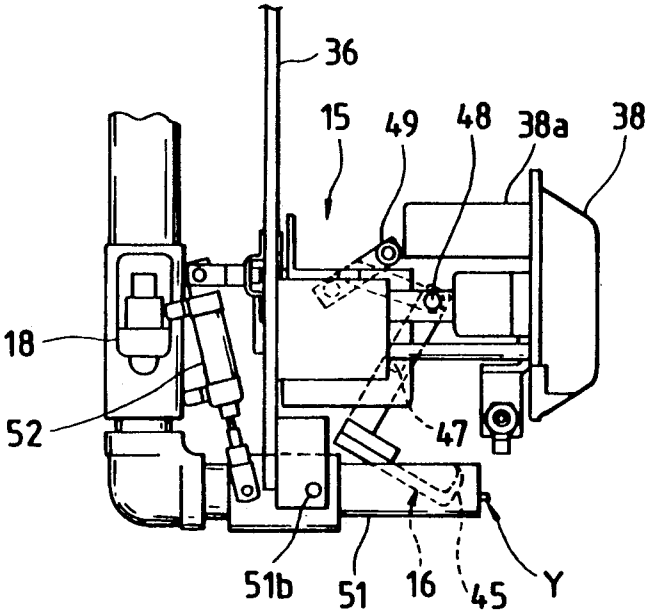

In the suction pipe 18, as shown in FIGS. 8*a* and 8*b*, a pipe portion 51 is mounted to the base 36 pivotably through a shaft 51*b*, and a cylinder 52 is connected to the pipe portion 51. The pipe portion 51 is disposed so that a front end thereof is normally located in the stand-by position of the hook means 16, as shown in FIG. 8*a*, and it is rotated by the operation of the cylinder 52 so as to assume a position near the chuck means 19 which is positioned behind the cone portion 38, as shown in FIG. 8*c*. At the front end of the pipe portion 51 there is formed a suction end 51*a* which is open to a side part of the pipe portion 51 facing the hook portion 45 of the hook means 16, as shown in FIG. 8*b*. Further, a fiber sensor (not shown) for detecting whether yarn has been sucked into the pipe portion 51 or not is provided within or near the pipe portion 51.

Figure 9:
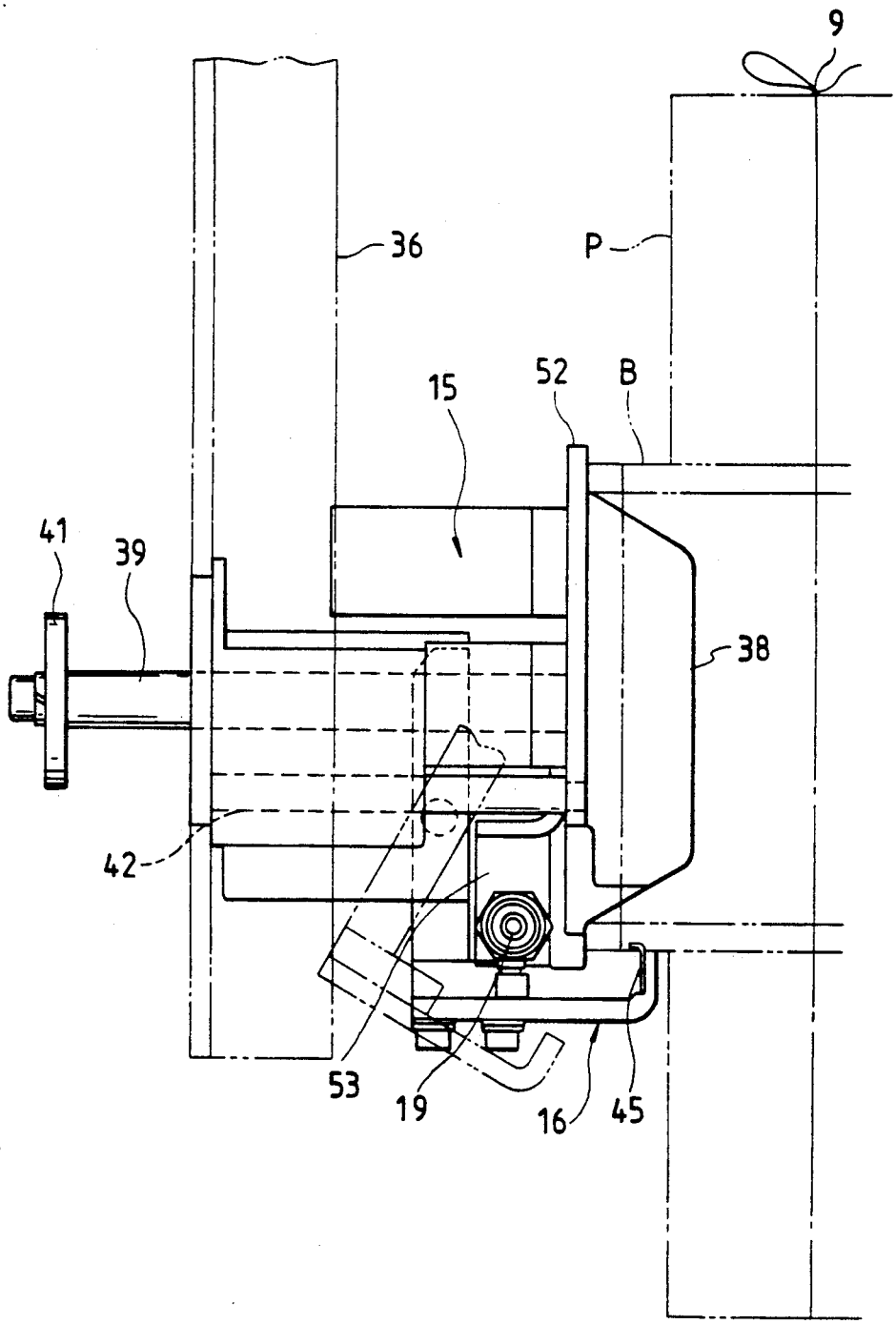
FIG. 9 is a view showing the details of a fitted state of the cone member in FIG. 2 into the paper spool.
Figure 10:
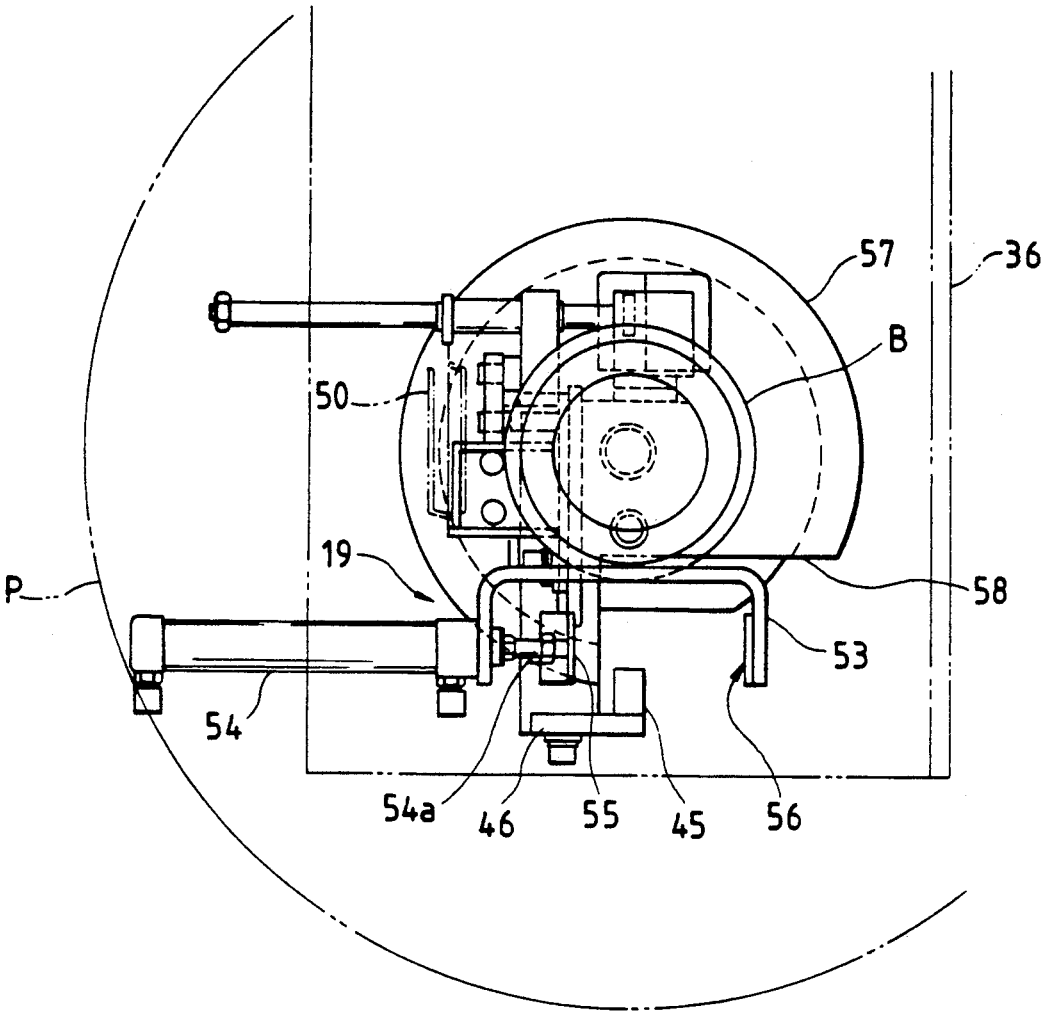
FIG. 10 is a left side view of FIG. 9.
Figure 11:
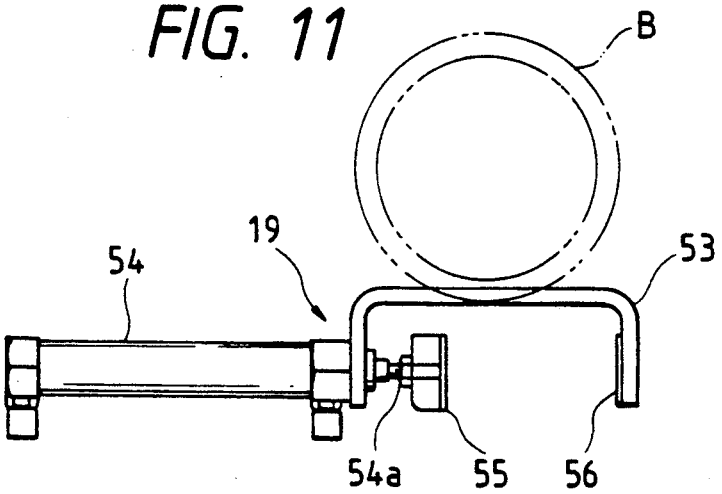
FIG. 11 is a detail view of a chuck means illustrated in FIG. 10.

In the chuck means 19, as shown in FIGS. 9 to 11, a chuck cylinder 54 is mounted to one side of an inverted U-shaped frame 53 which is attached to a disk 52 on the back of the cone portion 38. A movable chuck portion 55 is provided at a front end of a rod 54*a* of the cylinder 54, while on the other side of the frame 53 is provided a stationary chuck portion 56 in an opposed relation to the movable chuck portion 55. Upon operation of the cylinder 54, the movable chuck portion 55 comes into contact with the stationary chuck portion 56 to chuck yarn therebetween.

A disk 57 provided on the back side of the cone portion 38 is formed with a cutout portion 58 so that the yarn which has been hooked by the hook portion 45 passes between the stationary chuck portion 56 and the movable chuck portion 55 of the chuck means 19, as shown in FIG. 10.

The yarn removing means 17 will be described below with reference to FIGS. 12*a*–13*b*.

A drive motor 60 is mounted to the base 36, and a driving sprocket 61 is attached to the motor 60. Further, a driven sprocket 63, which is rotated by the driving sprocket 61 through a chain 62, is attached to the base 36 rotatably. The driven sprocket 63 is provided with a cam 64 and a rotating arm 65 for integral rotation with the sprocket 63. A link plate 66 is mounted to the base 36 rotatable through a stationary shaft 67, and a cam roller 68 is provided at one end of the link plate 66 in such a manner that the cam roller 68 is kept in contact with the cam 64 by means of a spring 69 connected to the link plate 66. To the other end of the link plate 66 is connected a swing arm 71 through a pin 70. The swing arm 71 and the rotating arm 65 are connected at the other ends thereof to a support plate 73 of a yarn take-up arm 72 through pins 74 and 75.

A pair of yarn take-up arms 72, which are opened and closed by means of a yarn take-up cylinder 76, are mounted to the support plate 73.

Figure 12C:
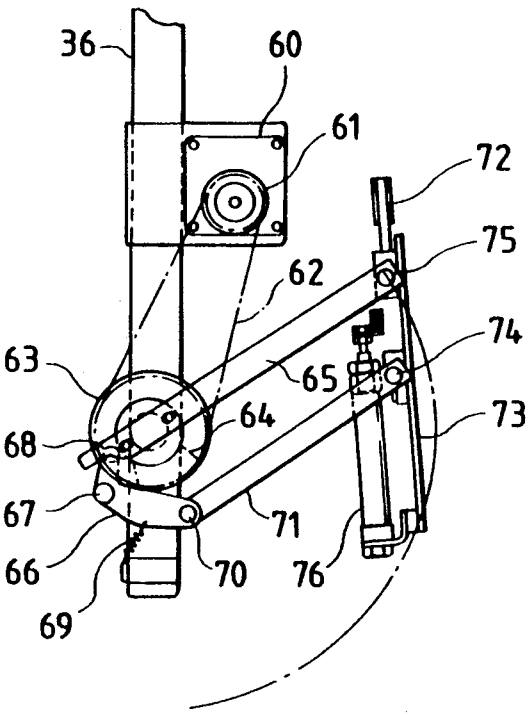
FIGS. 12*a*, 12*b* and 12*c* are views showing the details of a yarn removing means illustrated in FIG. 2.
Figure 12B:
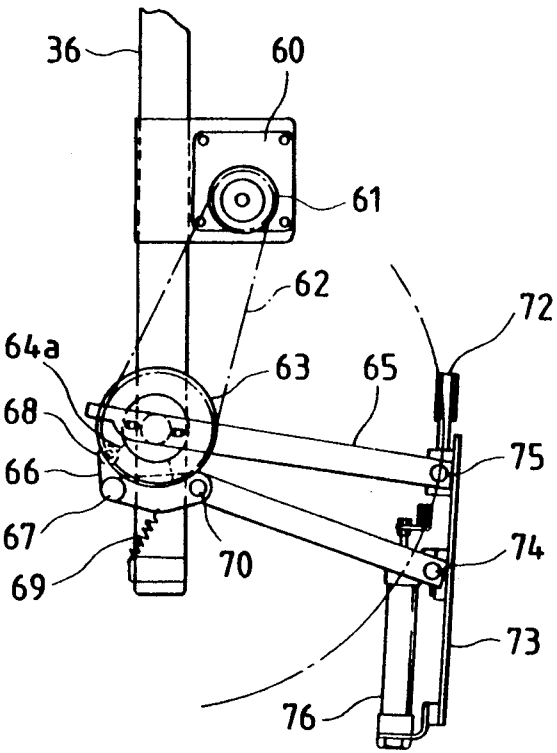
Figure 12A:
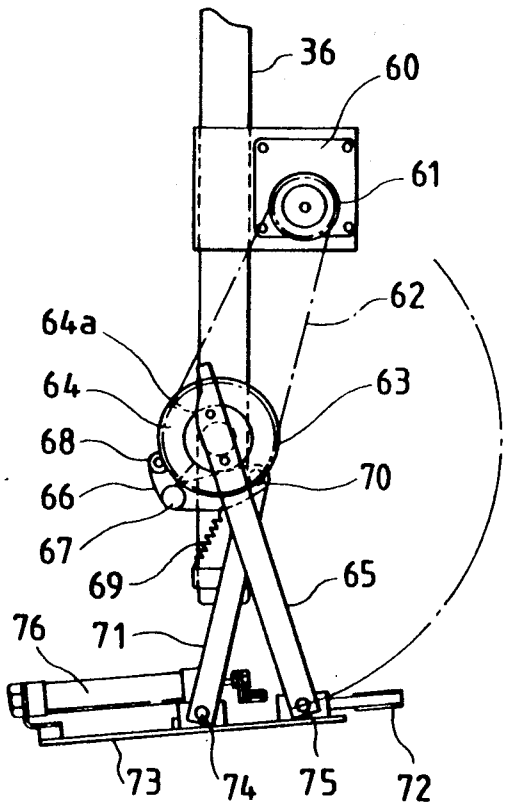

In FIG. 12, the support plate 73 for the yarn take-up arms 72 is in its stand-by position shown in FIG. 12*a*, and when the driven sprocket 63 is rotated by the drive motor 60, the support plate 73 is turned in the counterclockwise direction until it assumes an approximately vertical position, as shown in FIG. 12*b*. In the state illustrated in FIG. 12*b*, the cam roller 68 of the link plate 66 gets in a cam groove 64*a* of the cam 64. With further rotation of the sprocket 63 and the rotating arm 65, the cam roller 68 rotates along the cam groove 64*a* and the link plate 66 turns clockwise about the stationary shaft 67, so that the swing arm 71 is somewhat brought down through the pin 70 of the link plate 66. As a results as shown in FIGS. 12*b* to 12*c*, the support plate 73 rises nearly vertically along the end face of the paper tube B without abutment of its lower end with the paper tube.

Figure 13B:
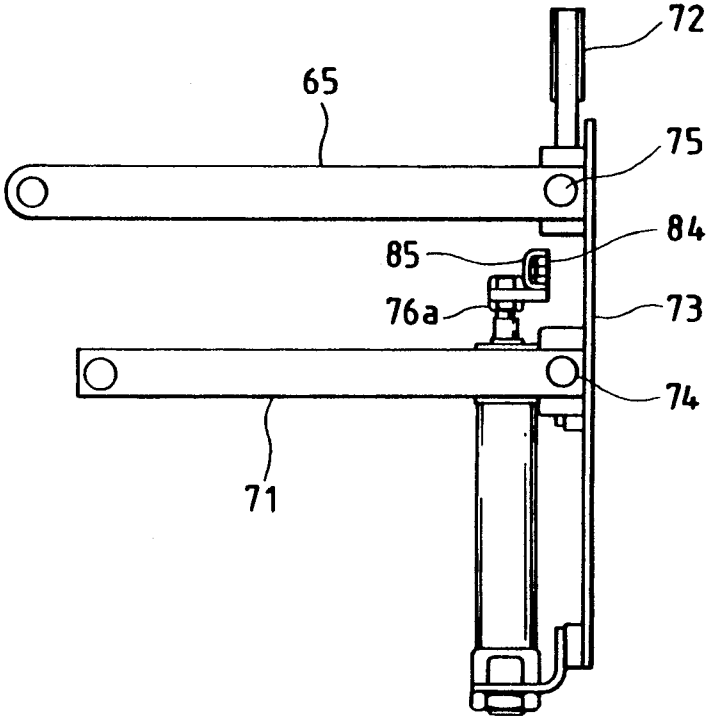
FIGS. 13*a* and 13*b* are views showing the details of yarn take-up arms illustrated in FIG. 12.

The details of the yarn take-up arm will be described below with reference to FIGS. 13*a* and 13*b*.

On the support plate 73 is provided a support shaft 80 projectingly, and the paired yarn take-up arms 72 are mounted pivotably on the support shaft 80. The yarn take-up arms 72 each comprise an arm portion 81 mounted on the support shaft 80 and a <-shaped yarn take-up portion 82 positioned at a front end of the arm portion 81. In the bent part of the yarn take-up portion 82 there is formed a yarn dropping slot 83 so that the slot 83 moves along the outer peripheral surface of the paper tube B as the yarn take-up arms 72 rotate with the support shaft 80 positioned on the axis of the paper tube.

The arm portion 81 of each yarn take-up arm 72 is provided with a roller 84, while to a rod 76*a* of the yarn take-up cylinder 76 there is mounted a guide member 85 of turned square U-shaped section in which are fitted the rollers 84 of the arms 72.

Figure 13A:
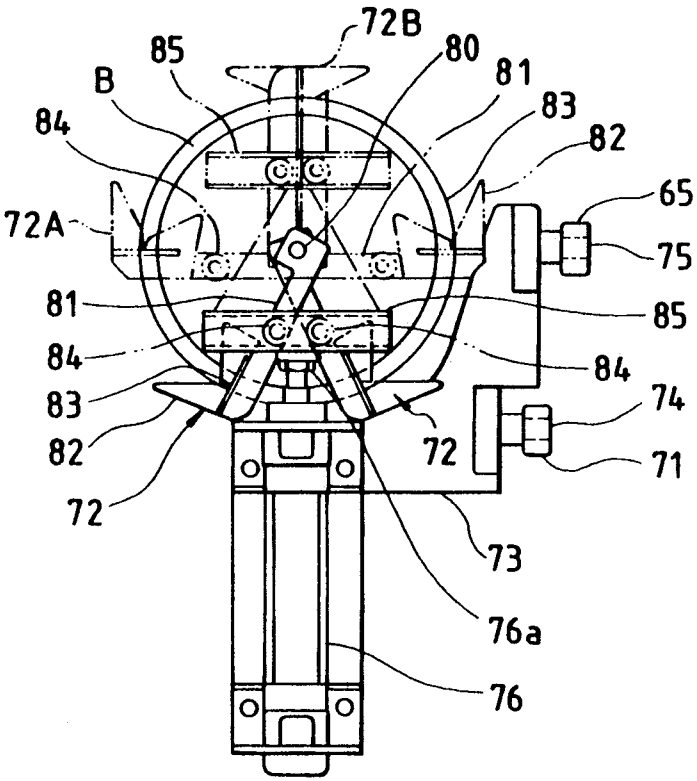

When the rod 76*a* of the yarn take-up cylinder 76 is in its retreated position as shown in FIG. 13*a*, the guide member 85 is in its solid line position illustrated in the figure. In this state, both yarn take-up arms 72 are at an approaching angle at their backs. When in this state the rod 76*a* extends up to a position near the support shaft 80, both yarn-take up arms 72 are moved pivotally up to a rectilinear state indicated at 72A by the rollers 84 engaged with the guide member 85. With further extension of the rod 76*a* and rotation of the guide member 85 up to a dash-double dot line position shown in the figure, both arms 72 turn up to the indicated at 72B, and the yarn present on the peripheral surface of the paper spool B is caught and gripped between the yarn take-up portions 82.

Figure 14:
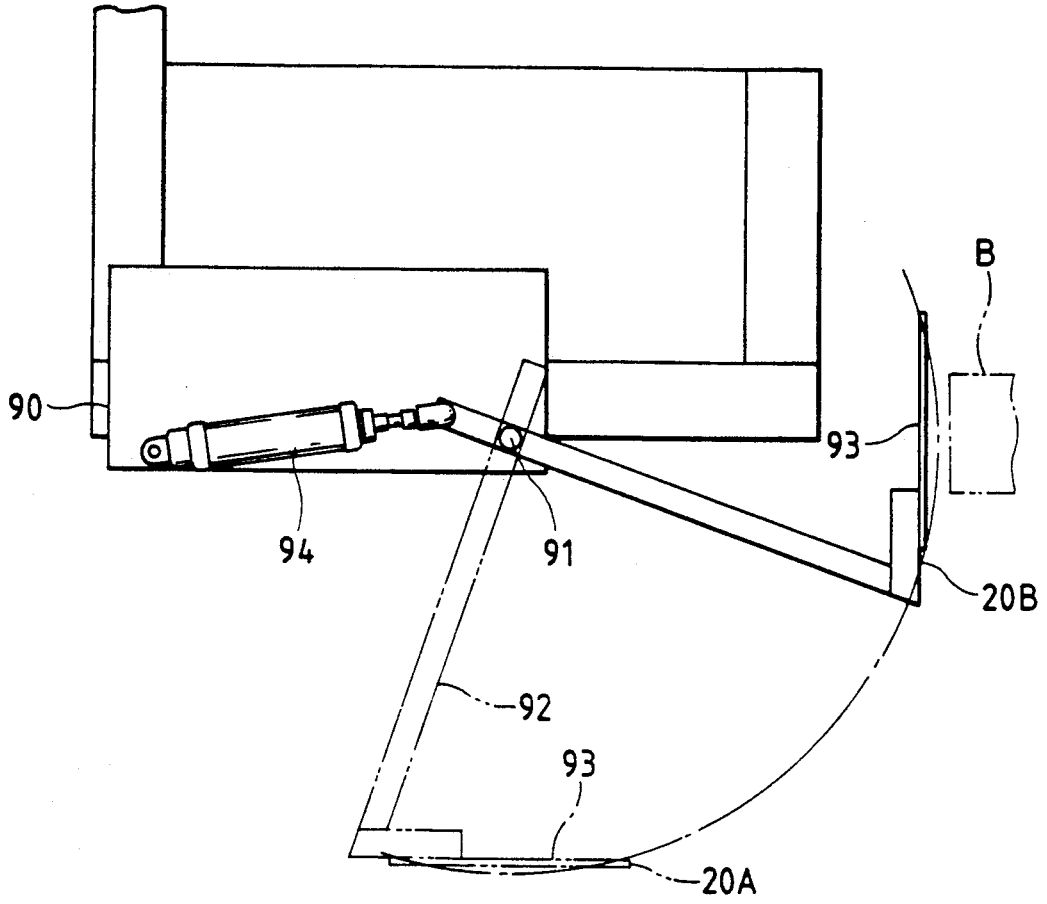
FIG. 14 is a view showing the details of a sub-ring means illustrated in FIG. 2.
Figure 15:
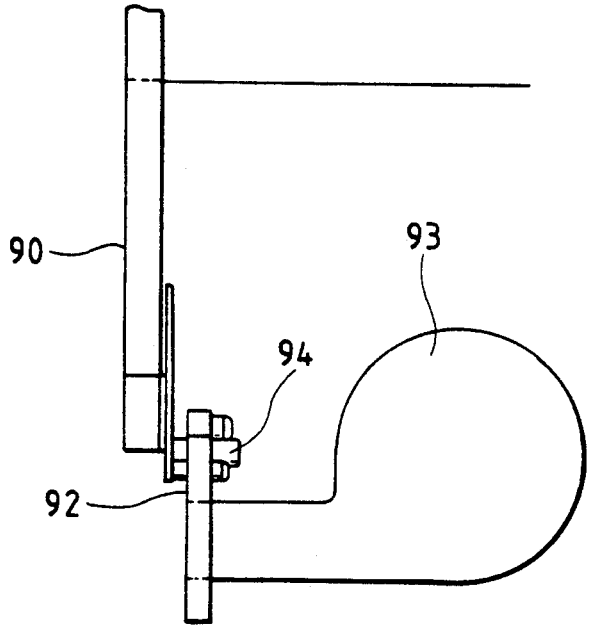
FIG. 15 is a left side view of FIG. 14.

The sub-ring means 20 will be described below with reference to FIGS. 14 and 15.

To a stationary frame 90 of the support frame 7 is connected a swing arm 92 pivotably through a shaft 91, and a ring plate 93 having a diameter much larger than that of the paper tube B is attached to a lower end of the swing arm 92, while to an upper end of the swing arm 92 is connected a cylinder 94. When the cylinder 94 is in its extended position the sub-ring means 20 assumes stand-by position 20A, while when the cylinder 94 is in its withdrawn position, the sub-ring means 20 occupies an operative position 20B and the ring plate 93 is turned to a position coincident with the axis of the paper tube B.

Figure 16C:
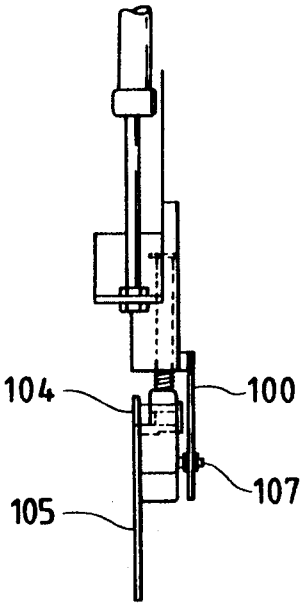
FIGS. 16*a*, 16*b* and 16*c* are views showing a modification of the paper spool pressing means illustrated in FIG. 4.
Figure 16B:
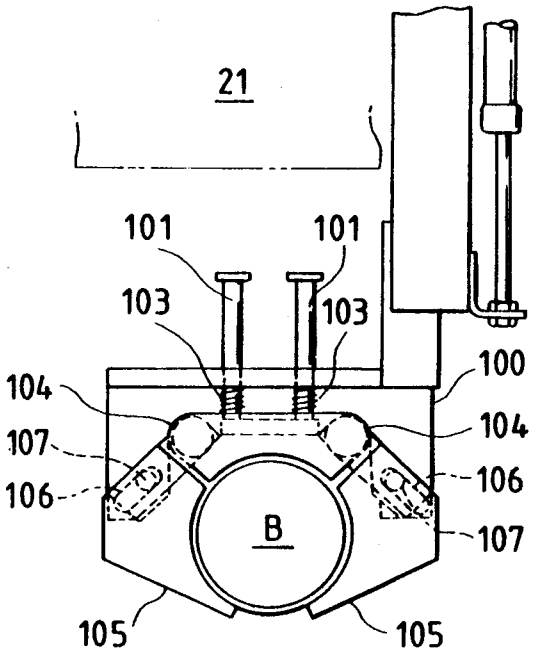
Figure 16A:
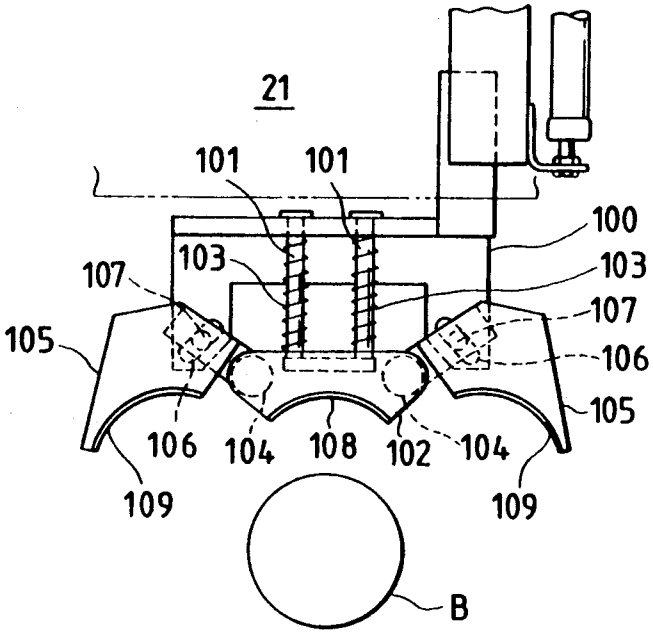

Referring to FIGS. 16*a* to 16*c*, there is illustrated a modification of the presser plate 23 of the paper tube pressing means 10 which has been explained in connection with FIG. 4.

A turned square U-shaped pressing base 100 is provided vertically movable with respect to the stationary support 21 and it is moved vertically by the means of the lift cylinder 24 (see FIG. 4). A pair of vertically movable rods 101, 101 are inserted through the pressing base 100, and a central presser plate 102 is provided at lower ends of the rods 101. Further, springs 103, 103 are mounted on the rods 101, 101 extending between the presser plate 102 and the pressing base 100. To both ends of the presser plate 102 are connected side presser plates 105 pivotably through connecting pins 104. Further, elongated holes 106 are formed in both ends of the pressing base 100, and pivot pins 107 attached to the presser plate 102 are engaged with the holes 106. The central presser plate 102 and the side presser plates 105 are formed with recesses 108 and 109, respectively, which are each in the form of a circular arc conforming to the curvature of the paper tube B.

In the modification illustrated in FIGS. 16*a*–16*c*, the pressing base 100 goes down from the state of FIG. 16*a* and the recess 108 of the central presser plate 102 positioned under the base 100 comes into abutment with the paper tube B. From this state, with further descent of the pressing base 100, the springs 103 are contracted and the base 100 goes down in a stopped state of the central presser plate 102 in abutment with the paper tube B. At the same time, the side presser plates 105 move pivotally toward the paper tube through the pivot pins 107 engaged with the elongated holes 106, so that the paper tube B is held grippingly substantially throughout the whole circumference thereof by the central and side presser plates 102, 105, as shown in FIG. 16*b*. In this modification shown in FIGS. 16*a*–16*c*, unlike holding the upper half of the paper tube B as in FIG. 4, since the paper tube is held substantially throughout the whole circumference thereof, it can be held more firmly.

The details of various portions of the yarn processing device 14 have been described above, and now the following description is provided about bunch winding processing steps which are carried out by this device, with reference to FIGS. 17*a* to 28*b*. In FIGS. 17*a*–21*b* and 23*a*–28*b*, "a" is a front view of the processing device 14 and "b" is a side view of the package P as seen from the processing device 14 side.

Figure 17A:
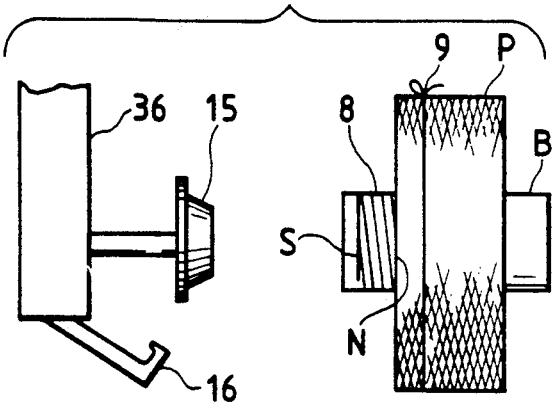
FIGS. 17*a* and 17*b* are schematic explanatory views showing a state of a start of a bunch winding processing according to the present invention.
Figure 17B:
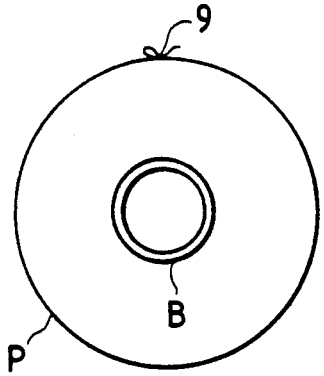

First, as shown in FIG. 17*a*, a start end of yarn is retained in the slit S formed in the paper tube B of the package P, then a bunch winding 8 is made, followed by a regular winding from the nip point N. A winding terminal end of the package P fed to this processing device is in a tied state, indicated at 9, on the outer periphery of the package, but this tied state is omitted in the following drawings.

Figure 18A:
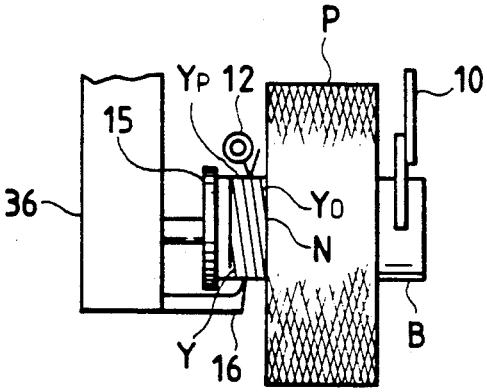
FIGS. 18*a* and 18*b* are schematic explanatory views of the cone member as fitted in a paper spool and the bunch yarn guide in operation in the bunch yarn processing according to the invention.

In FIG. 17*a*, when the base 36 moves toward the paper tube B and comes into engagement with the paper tube B as in FIG. 18*a*, the hook portion 45 of the hook means 16 abuts the underside of the paper tube B, which tube is fixed at the other end thereof by the paper tube pressing means 10.

Next, the bunch yarn guide 12 rotates and a front end thereof presses down a predetermined yarn portion $Y_p$ of the bunch winding yarn 8. The length from this pressed point of the yarn $Y_p$ up to the nip point N is a length necessary for the subsequent step, while the yarn portion from the pressed point of yarn $Y_p$ up to the yarn start end on the slit S side is a yarn portion which is to be unwound in this processing.

Figure 18B:
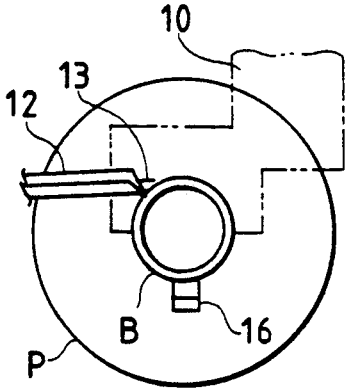
Figure 19A:
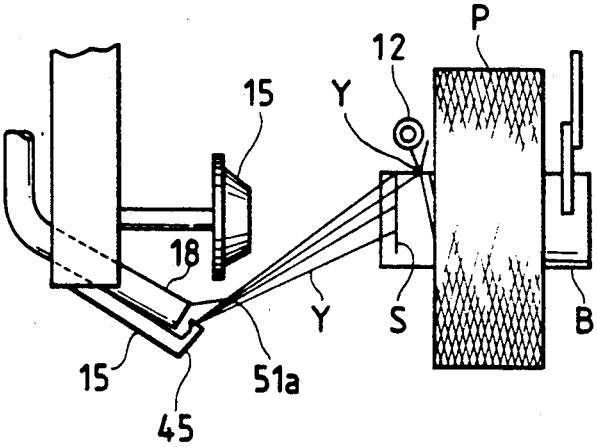
FIGS. 19*a* and 19*b* are schematic explanatory views of a bunch winding yarn as unwound by the hook means in the bunch winding processing according to the invention.
Figure 19B:
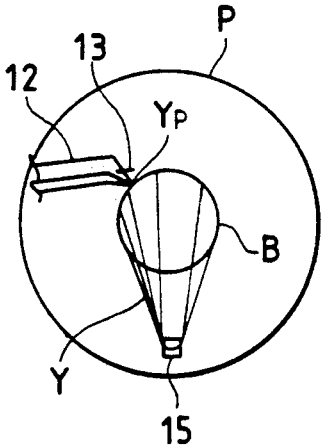

In the state of FIGS. 18*a*, and 18*b* when the base 36 moves away from the package P, the hook portion 45 of the hook means 16 hooks the yarn Y of the bunch winding 8, as shown in FIGS. 19*a* and 19*b*. In this case, the bunch yarn guide 12 holds the yarn portion $Y_p$ from the pressed point of yarn $Y_p$ up to the nip point N to prevent it from being unwound when the hook portion 45 moves back.

Figure 20A:
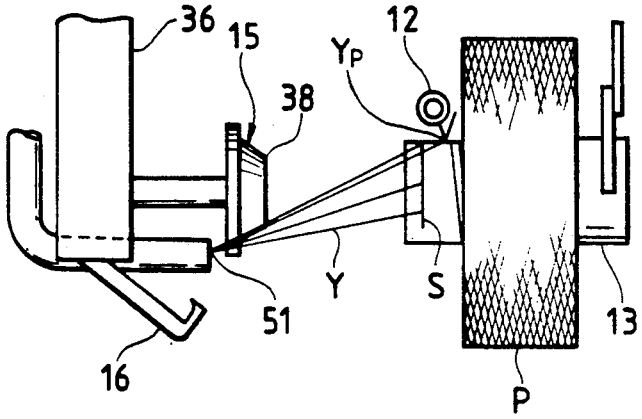
FIGS. 20*a* and 20*b* are schematic explanatory views of the unwound bunch yarn as sucked by the suction pipe in the bunch winding processing according to the invention.
Figure 20B:
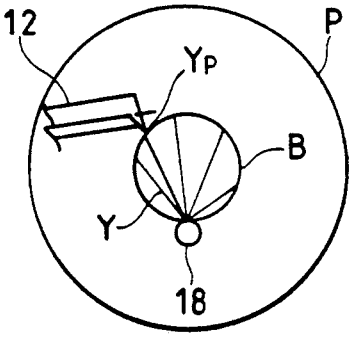

Next, upon complete retreat of the base 36 as shown in FIGS. 20*a* and 20*b*, the hook means 16 turns downward to guide the bunch winding yarn Y which has been hooked by the hook portion 45 to the position of the suction pipe 18. The yarn Y is sucked by the suction pipe 18, which in turn detects the suction of the yarn with a sensor or the like. Thereafter, from the stand-by position, the suction end 51*a* as the front end of the pipe portion 51 is turned up to a position near the cone portion 38 of the cone member 15, as shown in FIGS. 20*a* and 20*b*.

Figure 21A:
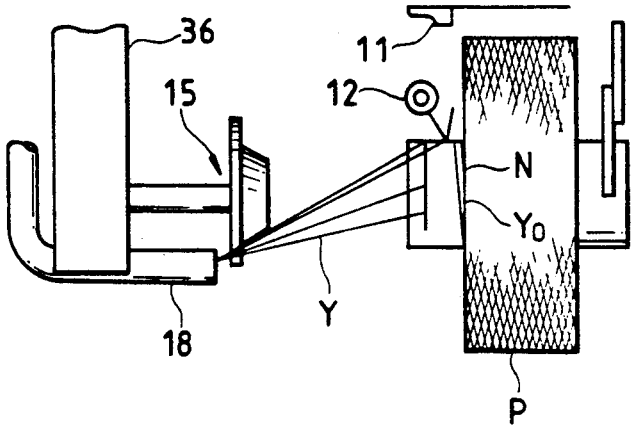
FIGS. 21*a* and 21*b* are schematic explanatory views showing an operating state of a bunch seal sticker in the bunch winding processing according to the invention.
Figure 21B:
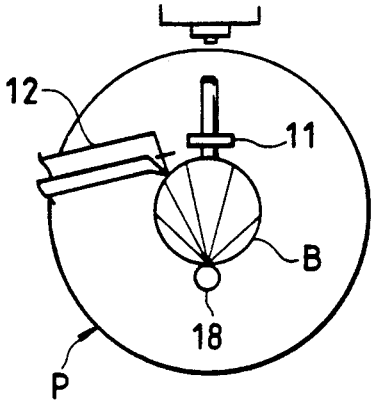
Figure 22:
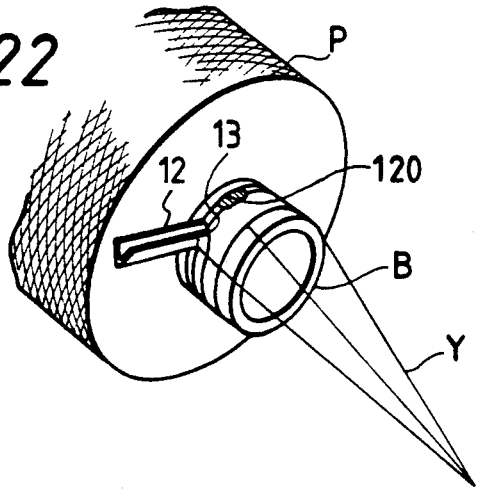
FIG. 22 is a perspective view of a package with a bunch seal applied thereto in the bunch winding processing according to the invention.

With the yarn Y sucked by the suction pipe 18, the bunch seal sticker 11 goes down as shown in FIG. 21*b*, toward the yarn $Y_o$ on the nip point N side rather than the yarn $Y_p$ pressed by the bunch yarn guide 12, to stick a bunch seal 120, whereby the yarn $Y_o$ is retained on the paper tube B.

Figure 23A:
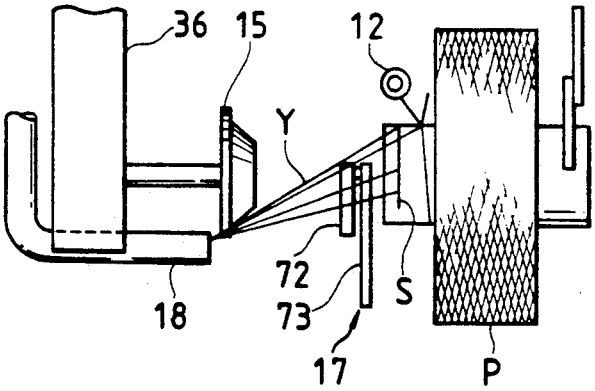
FIGS. 23*a* and 23*b* are schematic explanatory views showing an operating state of the yarn removing means in the bunch winding processing according to the invention.
Figure 23B:
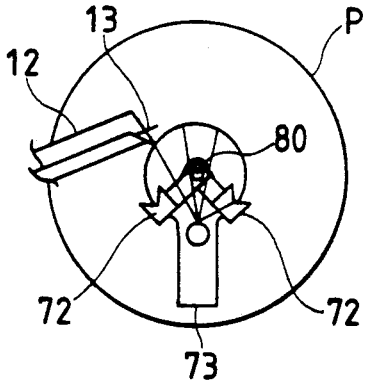

Next, the bunch winding yarn Y is unwound. In this case, the yarn is not in the form of a single yarn from the pressed point $Y_p$ to the suction pipe 18. As shown in FIGS. 19*a* to 21*b*, the yarn Y is in the form of several lines from the periphery of the paper tube B toward the suction pipe 18, partly biting into the slit S. In this connection, as shown in FIGS. 23*a* and 23*b*, the yarn removing means 17 operates and is positioned so that its support plate 73 becomes parallel to the end face of the paper tube. In this case, the yarn take-up arms 72 are in an open state and the support shaft 80 for the arms is coincident with the axis of the paper tube B, as shown in FIG. 23*b*.

Figure 24A:
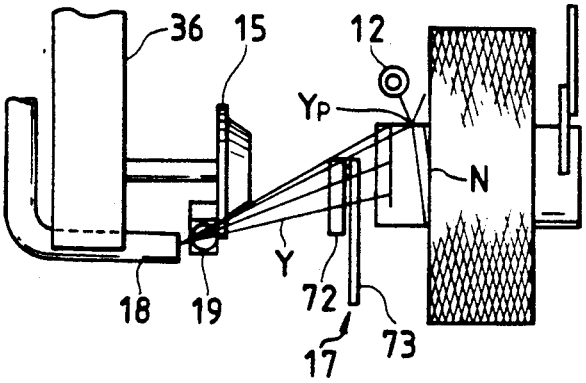
FIGS. 24*a* and 24*b* are schematic explanatory views showing an operating state of the chuck means in the bunch winding processing according to the invention.
Figure 24B:
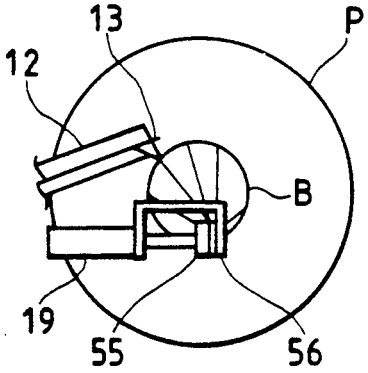

At the same time, as shown in FIG. 24*b*, the cylinder 54 of the chuck means 19 operates to move the movable chuck 55 to the stationary chuck 56, whereby the yarn Y on the suction pipe 18 side is chucked between the chucks.

Figure 25A:
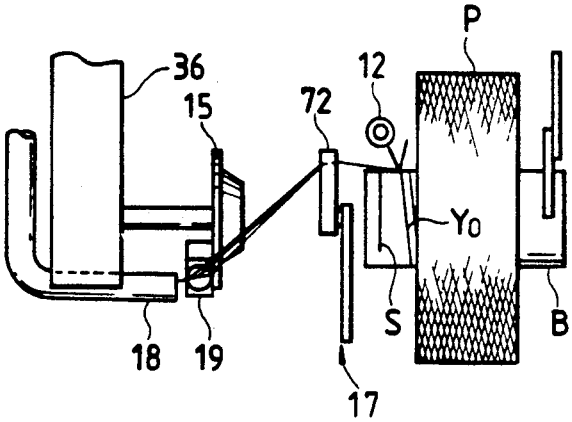
FIGS. 25*a* and 25*b* are schematic explanatory views showing an operating state of the yarn take-up arms of the yarn removing means in the bunch winding processing according to the invention.
Figure 25B:
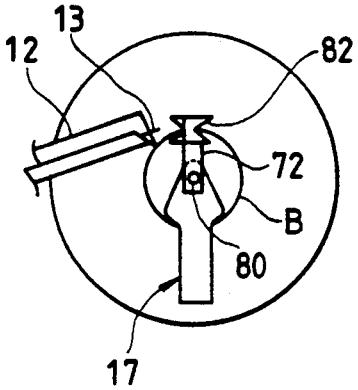

After the yarn Y on the suction pipe 18 side has been chucked by the chuck means in the manner just mentioned above, the yarn take-up arms 72 are turned in the closing direction as shown in FIGS. 25*a* and 25*b*. The yarn take-up portions 82 of the arms 72 move along the peripheral surface of the paper tube B and take up and bundle the yarn on the peripheral surface. In this case, since the yarn on the suction pipe 18 side is fixed by the chuck means 19, the yarn portion biting into the slit S is disengaged from the slit.

Figure 26A:
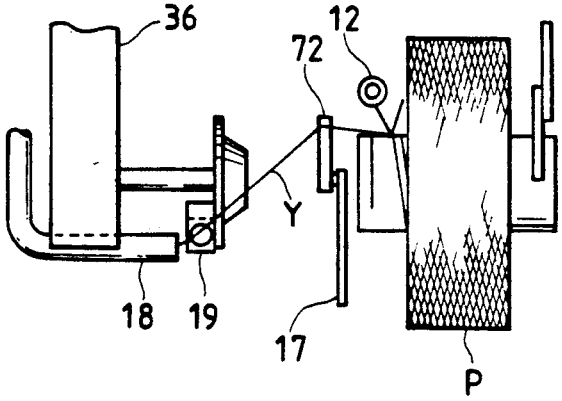
FIGS. 26*a* and 26*b* are schematic explanatory views showing a released state of the chuck means in the bunch winding processing according to the invention.
Figure 26B:
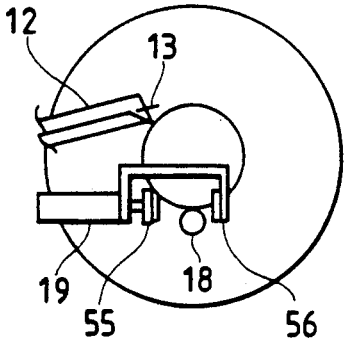
Figure 27A:
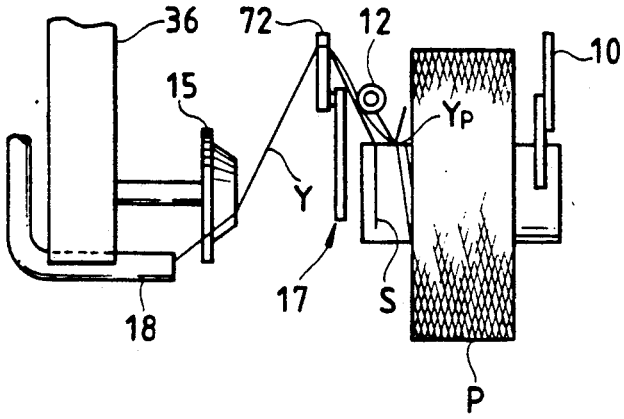
FIGS. 27*a* and 27*b* are schematic explanatory views showing a state wherein yarn which has bitten into a slit is removed by the yarn removing means and also showing a state wherein yarn is cut by a heat cutter, in the bunch winding processing according to the invention.
Figure 27B:
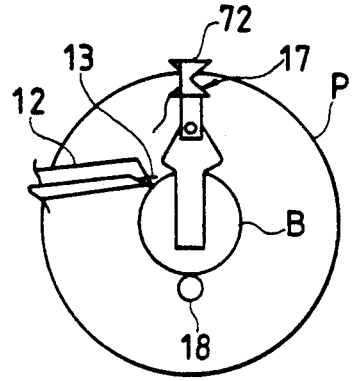

Next, when the chucked state of the yarn Y by the chuck means 19 is released, the yarn is in a sucked state to the suction pipe 18 from the yarn take-up arms 72, as shown in FIG. 26*b*. In this state, the heat cutter 13 in the bunch yarn guide 12 is kept heated, and when the support plate 73 is further moved upward, the yarn portion biting into the slit S is disengaged completely from the slit. With a further ascent of the support plate, as shown in FIG. 27, the yarn held by the arms 72 is lifted from the pressed point $Y_p$ by the arms, so that the yarn comes into contact with the heat cutter 13 and is cut thermally thereby.

Figure 28A:
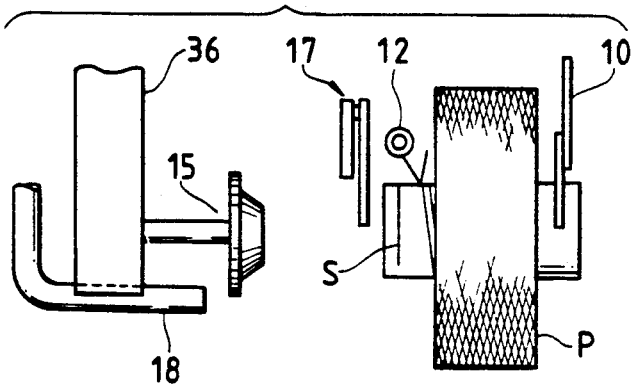
FIGS. 28*a* and 28*b* are schematic explanatory views showing a released state of the yarn take-up arms of the yarn removing means in the bunch winding processing according to the invention.
Figure 28B:
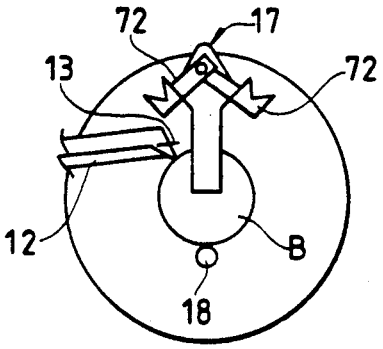
Figure 29A:
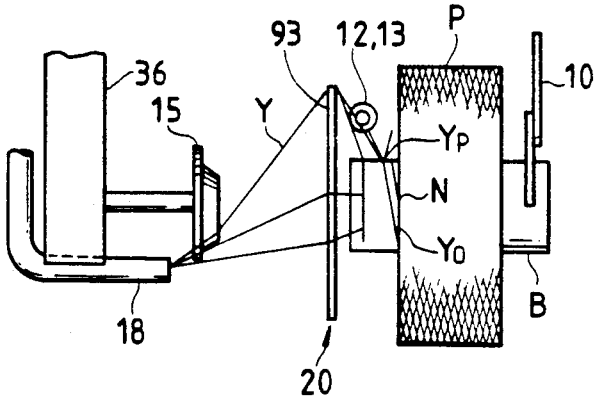
FIGS. 29*a* and 29*b* are schematic explanatory views showing a bunch winding processing according to another embodiment of the invention and showing a state wherein the sub-ring means has been operated from the state illustrated in FIG. 21.
Figure 29B:
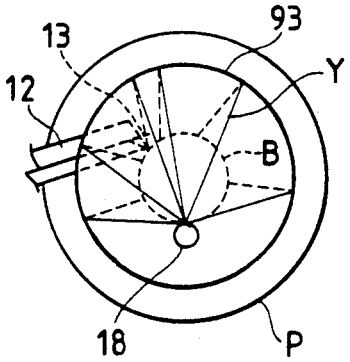

Thereafter, as shown in FIG. 28*b*, when the yarn take-up arms 72 are opened, the yarn is sucked and removed completely by the suction pipe 18, allowing the yarn portion $Y_o$ from the point of yarn $Y_p$ pressed by the bunch yarn guide 12 up to the nip point N to remain. Then, the yarn removing means 17 is returned to its stand-by position and the paper tube pressing means 10 is brought up; further, the bunch yarn guide 12 is turned upward. Now, the yarn processing is over, ready for yarn processing for the package P to be fed next.

FIGS. 29*a* to 31*b* illustrate another embodiment of the present invention, in which bunch unwinding is performed using the sub-ring means 20. The above descriptions of FIGS. 17*a* to 22*b*, out of FIGS. 17*a* to 28*b* referred to above, are also applicable to this embodiment. In this embodiment, a bunch seal 120 is stuck on the yarn $Y_o$ of a predetermined length.

After the bunch seal sticker 11 has been brought up in the state shown in FIGS. 21*a* and 21*b*, the ring plate 93 of the sub-ring means 20 is turned up to the same position as the axis of the paper tube B, whereupon the yarn portion biting into the slit S is expanded from the slit by the outer periphery of the ring plate 93 and is thereafter sucked by the suction pipe 18. At this time, since the heat cutter 13 in the bunch yarn guide 12 is in a heated state, the yarn portion on the ring plate 93 side from the pressed point of yarn $Y_p$ is cut thermally.

Figure 30A:
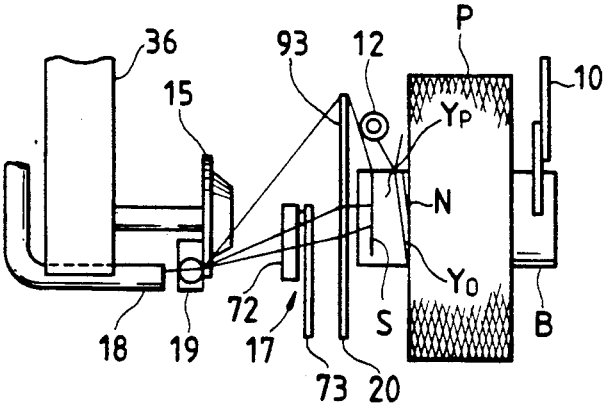
FIGS. 30*a* and 30*b* are schematic explanatory views showing an operating state of the yarn removing means and that of the chuck means in the another embodiment of the invention.
Figure 30B:
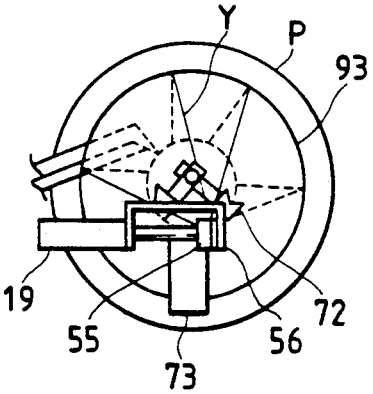
Figure 31A:
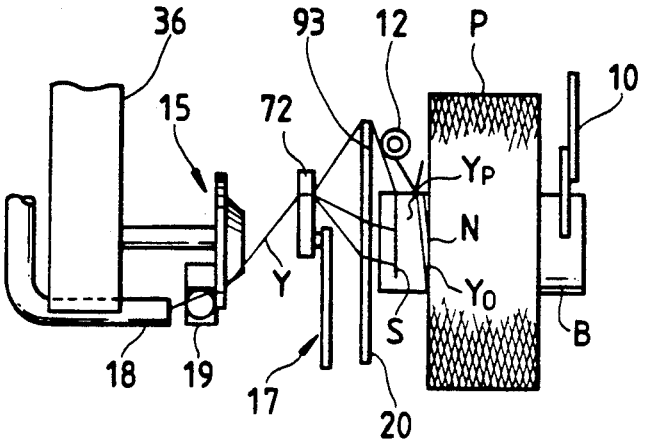
FIGS. 31*a* and 31*b* are schematic explanatory views showing a state wherein the cone member is moved back to remove yarn which has bitten into a slit in the another embodiment of the invention.
Figure 31B:
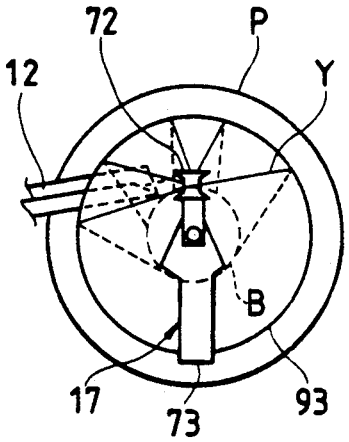

Then, the yarn Y on the suction pipe 18 is chucked by the chuck means 19, and in this state the support plate 73 of the yarn removing means 17 turns and is positioned between the ring plate 93 and the cone member 15, as shown in FIGS. 30*a* and 30*b*. At the same time, the yarn take-up arms 72 are operated as in FIGS. 31*a* and 31*b*, whereby the yarn Y positioned between the chucks of the chuck means 19 is bundled from the ring plate 93. When the base 36 is moved back from the state shown in FIGS. 31*a* and 31*b*, the portion of yarn in the slit S is pulled radially outward by the ring plate 93 and can be disengaged from the slit easily. Thereafter, the yarn take-up arms 73 are opened and the chucked state by the chuck means 19 is released, resulting in that the yarn Y is sucked and removed by the suction pipe 18. Thereafter, the yarn removing means and the sub-ring means 20 are turned up to the respective stand-by positions, and the bunch yarn guide 12 is turned upward. Now, the yarn processing is over.

According to the present invention, as set forth above, in a bunch winding yarn processing, yarn of a predetermined length from the nip point is pressed down by the bunch yarn guide and the yarn portion on the winding start end side from that pressed point is unwound. In this way it is possible to effect the unwinding of yarn without damage to the yarn which is to be left on the paper tube.

Figure 37:
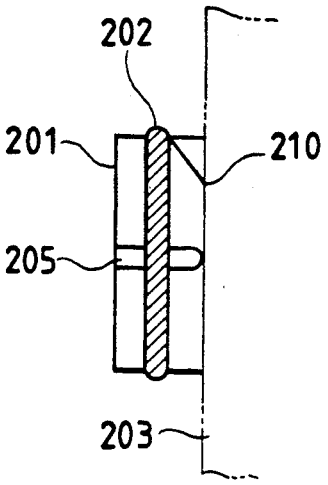
FIG. 37 is an enlarged view of a bunch winding portions.
Figure 38:
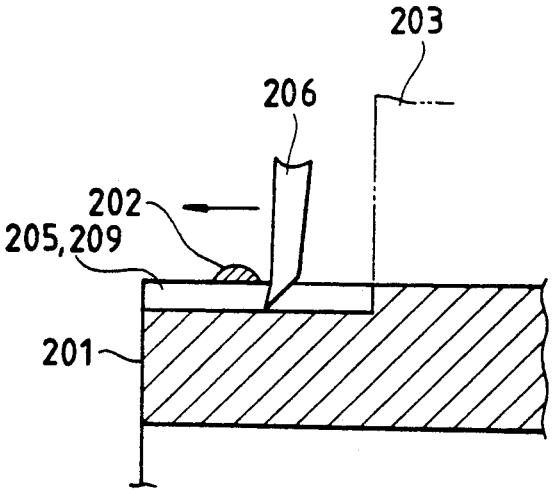
FIG. 38 is a view showing in what manner the bunch winding portion is unwound by means of a pawl-like jig.

According to the conventional paper tube structure, as shown in FIG. 37, a slit for retaining a start end of yarn is formed circumferentially in an end portion of a paper tube 201 onto which a bunch winding 202 is to be applied, and also formed is a slit-free portion, with a bunch winding take-out groove 205 being formed in the slit-free portion axially of the paper tube 201. According to this paper tube structure, as shown in FIG. 38, the bunch winding 202 can be released easily by inserting a pawl like jig 206 into the bunch winding take-out groove 205 and pulling it out in a hooked state of the bunch winding yarn 202. Thus, the start end of the yarn can be taken out easily.

In the above paper tube structure, in order to unwind the bunch winding 202 automatically by a yarn end processing machine, it is necessary to insert the pawl-like jig 206 accurately into the bunch winding take-out groove 205 formed in the paper tube 201. If the bunch winding 202 is unwound in a disengaged state of the jig 206 from the groove 205 of the paper tube, the jig 206 will be pulled out while it is hooked to the surface layer portion of the bunch winding 202, resulting in that the bunch winding is not completely unwound. In this case, there also is a fear of the jig 206 being caught in the slit portion of the paper tube 201 and damage to the surface of the paper tube.

The present invention has been accomplished in view of the aforementioned circumstances and the present invention provides a paper tube position detecting device for bunch processing capable of detecting a rotational position of a paper tube accurately at the time of unwinding a bunch winding on the paper-tube automatically by a yarn end processing machine.

In a first embodiment of the present invention, there is provided a device for detecting a paper tube position at the time of unwinding a bunch winding on a paper tube, the said device comprising a groove formed axially in an end portion of the paper tube to which a bunch winding is applied, and a convex, rotational position sensor which comes into abutment with the outer peripheral surface of the paper tube and engagement with the said groove as the paper tube rotates to detect a rotational position of the paper tube.

In a second embodiment of the present invention there is provided a device for detecting a paper tube position at the time of unwinding a bunch winding on a paper tube, the said device comprising a color mark applied axially to an end portion of the paper tube to which a bunch winding is applied, and a color sensor disposed in close proximity to the paper tube to detect the position of the color mark as the paper tube rotates, thereby detecting a rotational position of the paper tube.

According to the first embodiment of the present invention, the paper tube is rotated while the convex, rotational position sensor is kept in abutment with the outer peripheral surface of the paper tube, and the said sensor comes into engagement with the groove formed in the paper tube, whereby a rotational position of the paper tube can be detected accurately.

According to the second embodiment of the present invention, the paper tube is rotated while the color sensor is kept in proximity to the paper tube, and the color sensor detects the color mark on the paper tube, whereby a rotational position of the paper tube can be detected accurately.

Embodiments of the present invention will be described below with reference to the accompanying drawings.

The first embodiment of the present invention will now be described with reference to FIGS. 32 to 34. As shown in FIG. 33, a slit 207 is formed circumferentially in an end portion of a paper tube 201 to which a bunch winding is applied. The slit 207 is formed not throughout the whole circumference of the paper tube 201 but in such a manner that there remains a slit-free portion 208 of a certain width. In the slit-free portion 208 there is formed a groove 209 axially of the paper tube 201, the groove 209 extending from an end face of the paper tube up to a regular winding portion 203 (package portion). A start end of yarn is retained in the slit 207 of the paper tube 201 and thereafter the yarn is wound round an end portion of a bobbin to make a bunch winding 202, so as shown in FIG. 37. Then, the regular winding 203 is applied from a nip point 210 to form a package.

Figure 34:
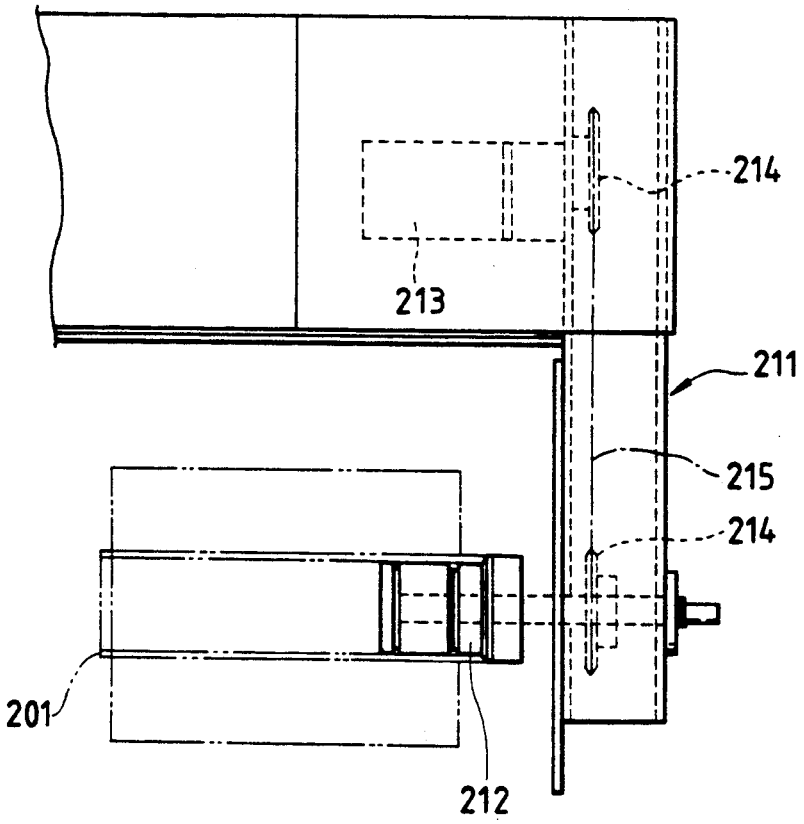
FIG. 34 is a side view of a rotating mechanism for rotating the paper tube.

The paper tube 201 is rotated by means of a rotating mechanism 211 which is shown in FIG. 34. As illustrated in the same figure, the rotating mechanism 211 has a chucker 212 to be inserted into the paper tube 201, and a motor 213 for rotating the chucker 212. After the chucker 212 is inserted into the paper tube 201 and the diameter thereof is expanded for fixing to the paper tube, the motor 213 is operated. The rotating force of the motor 213 is transmitted to the chucker 212 through a sprocket and a chain 215 to rotate the chucker, whereby the paper tube 201 fixed to the chucker 212 is rotated.

Figure 32:
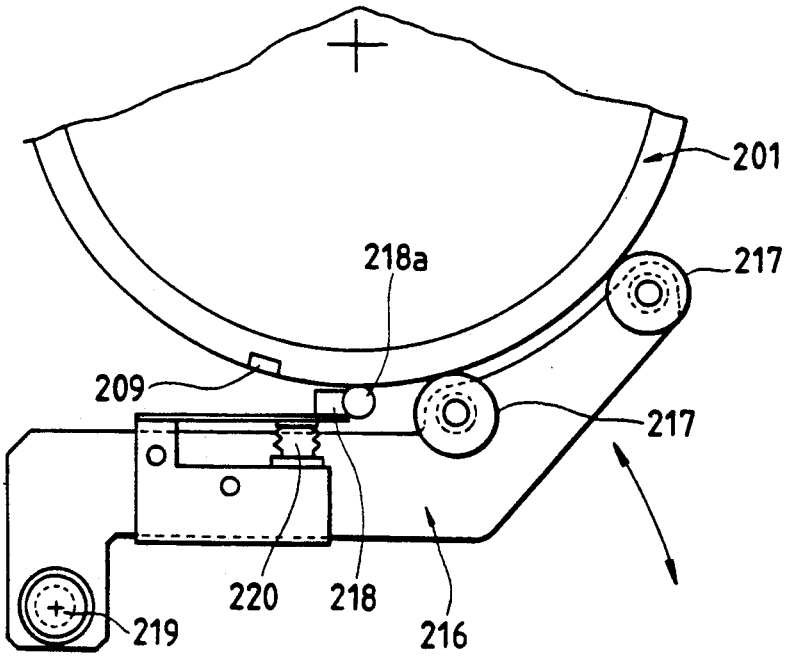
FIG. 32 is a schematic view of a principal portion of a paper tube position detecting device according to a further embodiment of the invention.
Figure 33:
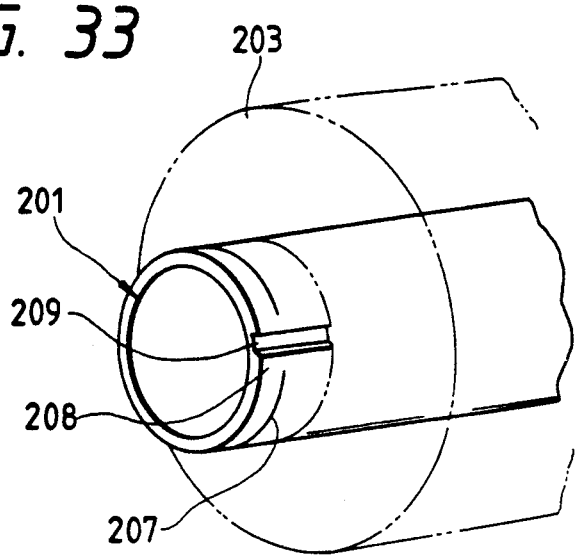
FIG. 33 is a perspective view of a paper tube illustrated in FIG. 32.

A groove position detecting device 216 which is shown in FIG. 32 comes into abutment with the paper tube 201 which has been set to the rotating mechanism 211. As illustrated in the same figure, the device 216 is provided with two rotating rollers 217 adapted to roll on the outer peripheral surface of the paper tube 201 and a convex, rotational position sensor 218 which comes into abutment with the outer peripheral surface of the paper tube. For movement into and out of contact with the outer peripheral surface of the paper tube 201, the groove position detecting device 216 can be moved pivotally about a fulcrum 219 by means of an air cylinder (not shown). In a contacted state of the detecting device 216 with the outer peripheral surface of the paper tube 201, as shown in FIG. 32, the rotating rollers 217 of the device 216 roll on the outer peripheral surface of the paper tube, and the convex, rotational position sensor 218 of the same device is pushed against the outer peripheral surface of the paper tube with a predetermined urging force. The sensor 218 has a limit switch 220 which turns on upon engagement of a convex portion 218*a* of the sensor with the groove 209 formed in the outer peripheral surface of the paper tube 201.

The operation of this embodiment constructed as above will be described below.

For unwinding the bunch winding 202 on the paper tube 201 automatically by a yarn end processing machine (not shown), the paper tube 201 is set to the rotating mechanism 211 shown in FIG. 34 and is then rotated while the convex, rotational position sensor 218 of the groove position detecting device 216 is kept in abutment with the outer peripheral surface of the paper tube. During the rotation of the paper tube 201, when the convex portion 218*a* of the sensor 218 comes into engagement with the groove 209 of the paper tube, the limit switch 220 turns on. In this way, the position of the groove 209 of the paper tube can be detected accurately, whereby, as shown in FIG. 38, the pawl-like jig 206 can be inserted automatically and accurately into the groove 209 of the paper tube with the bunch winding 202 applied thereto and the bunch winding 202 can be unwound easily and accurately as it is pulled out.

The groove 209 functions as both a groove for pulling out the bunch winding 202 and a mark for detecting the position of the groove 209. After unwinding of the bunch winding 202, the yarn of the bunch winding is cut while a predetermined length of yarn from the nip point 210 (shown in FIG. 37) is allowed to remain, and piecing is performed using the remaining yarn.

Next, the second embodiment of the present invention will now be described with reference to FIGS. 35 and 36. As illustrated in these figures, the paper tube position detecting device of this embodiment is of substantially the same construction as in the previous embodiment, different only in that a bar-like color mark 221 is applied onto the paper tube 201 in place of forming the groove 209 in the paper tube and that a color sensor 222 for detecting the position of the color mark 221 is provided in place of providing the convex, rotation position sensor 218 in the groove position detecting device 216.

Figure 35:
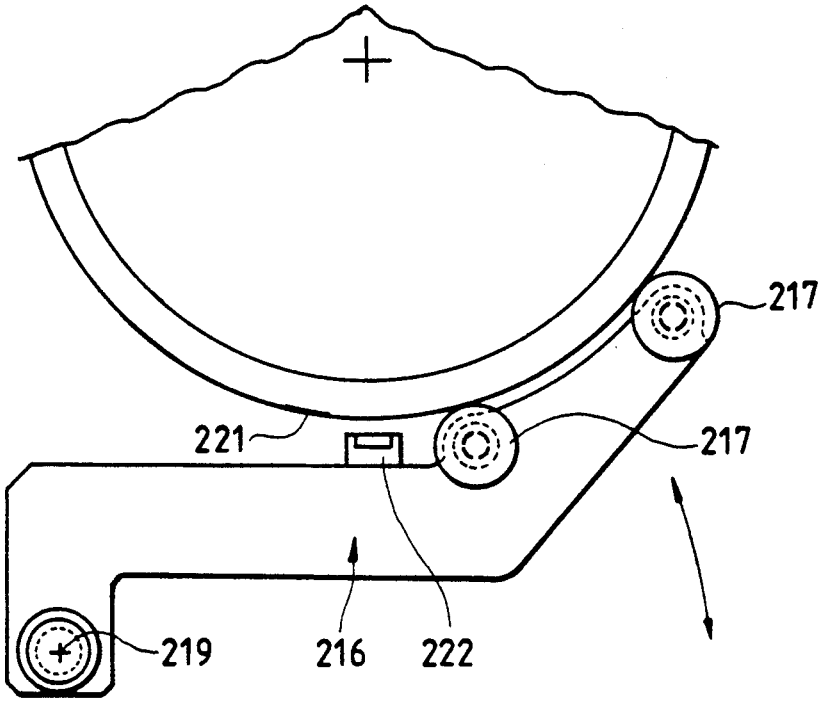
FIG. 35 is a schematic view of a principal portion of a paper tube position detecting device according to a still further embodiment of the present invention.
Figure 36:
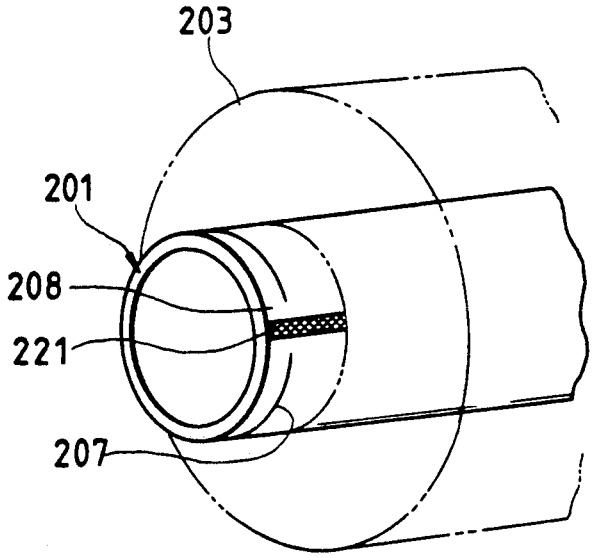
FIG. 36 is a perspective view of the paper tube illustrated in FIG. 35.

More specifically, as shown in FIG. 36, a slit 207 and a slit-free portion 208 are formed circumferentially in an end portion of the paper tube 201 to which is applied a bunch winding, and a bar-like color mark 221 is applied onto the slit-free portion 208 axially of the paper tube. On the other hand, as shown in FIG. 35, a groove position detecting device 216 used in this embodiment is provided with rotating rollers 217 adapted to roll on the outer peripheral surface of the paper tube 201 and a color sensor 222 for detecting the position of the color mark 221. The color sensor 222 radiates light to the outer peripheral surface of the paper tube 201 and detects a change in the amount of light reflected from the said outer peripheral surface, thereby detecting the position of the color mark 221 on the paper tube. As soon as the color sensor 222 detects the position of the color mark 221 on the paper tube 201, a limit switch (not shown) turns on.

The following description is now provided about the operation of this embodiment constructed as above.

For unwinding the bunch winding 202 on the paper tube 201 automatically by a yarn end processing machine, the paper tube is set to the rotating mechanism 211 shown in FIG. 34 and is then rotated while the color sensor 222 is kept in proximity to the outer peripheral surface of the paper tube, as shown in FIG. 35. During the rotation of the paper tube 201, when the color sensor 222 detects the position of the color mark 221, the limit switch turns on. In this way, the position of the color mark 221 on the paper tube 201 shown in FIG. 36 can be detected accurately and hence the pawl-like jig 206 can be positioned automatically and accurately on the slit-free portion 108 of the paper spool with the bunch winding 202 applied thereto. That is, at the time of automatic unwinding of the bunch winding 202, the jig 206 can be positioned accurately on the slit-free portion 208 without being caught in the slit 207 of the paper tube, so it is possible to unwind the bunch winding 202 easily and accurately.

According to the present invention, as set forth above, it is possible to accurately detect a rotational position of a paper tube at the time of unwinding a bunch winding on the paper tube. This is an outstanding effect.

What is claimed is:

1. A bunch winding yarn processing apparatus for a package having a start end of yarn retained in a slit formed in a tube, a bunch winding yarn, and a regular winding yarn defining a nip point, the apparatus comprising:

bunch winding yarn guide means for pressing the bunch winding yarn against the tube at a pressing location in spaced relationship with the nip point, and unwinding means for unwinding the bunch winding yarn between the pressing location and the start end of yarn.

2. The apparatus of claim 1 wherein the tube is rotatable and defines a first end and a second end, wherein the slit is formed adjacent the first end of the tube, and further comprising:

tube pressing means for pressing the second end of the tube to thereby stop rotation of the tube.

3. The apparatus of claim 2, wherein the tube defines a curvature and wherein the tube pressing means comprises:

a presser plate having a substantially arcuate recess defining a curvature conforming to the curvature of the tube, and means for bringing the presser plate and the tube into frictional contact.

4. The apparatus of claim 1, comprising:

a heat cutter for thermally cutting the bunch winding yarn.

5. The apparatus of claim 4, comprising:

bunch seal sticker means for retaining an end portion of the yarn on the tube after thermally cutting the bunch winding yarn.

6. The apparatus of claim 1, wherein the bunch yarn guide means comprises:

a guide body pivotable between a standby position and a pivoted position, means for moving the guide body between the standby position and the pivoted position, and a pressing pawl associated with the guide body, the pressing pawl and the guide body being configured so that the pressing pawl presses the bunch winding yarn against the tube at the pressing location when the guide body is in the pivoted position.

7. The apparatus of claim 6, wherein the guide body comprises a heater for thermally cutting the bunch winding yarn.

8. The apparatus of claim 1 further comprising bunch winding release means for releasing the bunch winding yarn, the bunch winding release means comprising:

a cone adapted to fit into the tube, hook means for hooking and unwinding the bunch winding yarn, and yarn removing means for gripping the bunch winding yarn unwound by the hook means and for removing the bunch winding yarn from the tube.

9. The apparatus of claim 8, further comprising:

base means for supporting the bunch winding release means, a rail along which the base means is moveable relative to the tube, and means for moving the base means along the rail.

10. The apparatus of claim 9, wherein the cone is rotatable and wherein the base means comprises means for preventing rotation of the cone.

11. The apparatus of claim 9, wherein the yarn removing means comprises:

a rotatable link plate, driving means for driving the link plate, a swing arm having a first end and a second end, the first end of the swing arm being connected to the link plate, a rotating arm having a first end and a second end, the first end of the rotating arm being connected to the driving means, a support plate connected to the second end of the swing arm and the second end of the rotating arm, a pair of yarn take-up arms mounted on the support plate, and means for opening and closing the pair of yarn take-up arms.

12. The apparatus of claim 11, wherein at least one of the pair of yarn take-up arms comprises:

an arm portion having at least one end and being mounted on a support shaft, a substantially L-shaped yarn take-up portion having a bent part and being positioned at the end of the arm portion, and a yarn dropping slot formed in the bent part of the yarn take-up portion.

13. The apparatus of claim 8, wherein the hook means 16 comprises a substantially L-shaped hook lever having a hook portion for hooking the bunch winding yarn, and means for pushing the hook portion against the tube to thereby hook the bunch winding yarn when the cone is fitted in the tube.

14. The apparatus of claim 8, wherein the bunch winding release mechanism comprises:

suction pipe means for sucking the bunch winding yarn, chuck means for chucking the yarn sucked by the suction pipe means, and sub-ring means for pushing the yarn unwound by the hook means away from the tube.

15. The apparatus of claim 14, wherein the chuck means comprises:

a substantially inverted U-shaped frame disposed on the cone, the U-shaped frame having a first side and a second side, a chuck cylinder mounted to the first side of the U-shaped frame, the chuck cylinder having a front end, a movable chuck portion provided at a front end of the chuck cylinder, and a stationary chuck portion provided on the second side of the U-shaped frame in opposed relation to the movable chuck portion, whereby the movable chuck portion and the stationary chuck portion come into contact to chuck a yarn therebetween.

16. The apparatus of claim 14, wherein the tube defines a diameter and an axis and wherein the sub-ring means comprises:

a pivotable swing arm having a first end and a second end, a cylinder connected to the first end of the swing arm 92, and a ring plate attached to the second end of the swing arm, the ring plate having a diameter substantially larger than the diameter of the tube, the ring plate being turned to a position substantially coincident with the axis of the tube.

* * * * *